US007629100B2

(12) United States Patent
Okamoto et al.

(10) Patent No.: US 7,629,100 B2
(45) Date of Patent: Dec. 8, 2009

(54) TONER

(75) Inventors: Naoki Okamoto, Mishima (JP); Tetsuya Ida, Mishima (JP); Koh Ishigami, Mishima (JP); Kazuo Terauchi, Numazu (JP); Yojiro Hotta, Mishima (JP); Noriyoshi Umeda, Susono (JP); Yoshinobu Baba, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 323 days.

(21) Appl. No.: 11/841,078

(22) Filed: Aug. 20, 2007

(65) Prior Publication Data

US 2009/0047592 A1 Feb. 19, 2009

Related U.S. Application Data

(63) Continuation of application No. PCT/JP2007/060367, filed on May 21, 2007.

(30) Foreign Application Priority Data

May 25, 2006 (JP) ..... 2006-145551

(51) Int. Cl.
*G03G 9/00* (2006.01)

(52) U.S. Cl. ..... 430/111.4; 430/109.3; 430/109.4

(58) Field of Classification Search ..... 430/111.4, 430/109.3, 109.4
See application file for complete search history.

(56) References Cited

U.S. PATENT DOCUMENTS 5,976,752 A * 11/1999 Matsunaga et al. ..... 430/108.23

(Continued)

FOREIGN PATENT DOCUMENTS

JP 2000275908 10/2000

(Continued)

OTHER PUBLICATIONS

Translation of International Preliminary Report on Patentability dated Dec. 24, 2008 for PCT/JP 2007/060367.

*Primary Examiner*—Mark A Chapman
(74) *Attorney, Agent, or Firm*—Fitzpatrick, Cella, Harper & Scinto

(57) ABSTRACT

An object of the present invention is to provide a toner which: is excellent in fixing ability such as low-temperature fixability, hot offset property, and separability even in a fixing system excellent in quick start property and energy saving property; has high gloss; and is excellent in development stability and transferability irrespective of environments. The toner of the present invention includes toner particles each containing at least a binder resin and a colorant, in which, in a case where a tetrahydrofuran (THF) insoluble matter of the binder resin in the toner when the toner is subjected to Soxhlet extraction with THF for 2 hours is represented by A (mass %), a THF insoluble matter of the binder resin in the toner when the toner is subjected to Soxhlet extraction with THF for 4 hours is represented by B (mass %), a THF insoluble matter of the binder resin in the toner when the toner is subjected to Soxhlet extraction with THF for 8 hours is represented by C (mass %), and a THF insoluble matter of the binder resin in the toner when the toner is subjected to Soxhlet extraction with THF for 16 hours is represented by D (mass %), A, B, C, and D satisfy the following expression: $(A-B)/2>(B-C)/4>(C-D)/8$ where $40<A\leqq 75$ (mass %) and $1.0<D<40$ (mass %).

5 Claims, 16 Drawing Sheets

U.S. PATENT DOCUMENTS

| | | | | |
|---|---|---|---|---|
| 6,586,147 | B2 | 7/2003 | Iida et al. | |
| 6,881,527 | B2 * | 4/2005 | Moribe et al. | 430/109.4 |
| 6,929,894 | B2 | 8/2005 | Sugahara et al. | |
| 6,946,228 | B2 | 9/2005 | Kanamaru et al. | |
| 7,147,980 | B2 | 12/2006 | Itakura et al. | 430/108.4 |
| 2004/0161688 | A1 | 8/2004 | Itakura et al. | 430/108.4 |
| 2004/0185364 | A1 | 9/2004 | Kanamaru et al. | |

FOREIGN PATENT DOCUMENTS

| | | |
|---|---|---|
| JP | 2001259451 | 9/2001 |
| JP | 2002214833 | 7/2002 |
| JP | 2002244338 | 8/2002 |
| JP | 2004085605 | 3/2004 |
| JP | 2004-157342 | 6/2004 |
| JP | 2004-233983 | 8/2004 |
| JP | 2004-333968 | 11/2004 |
| JP | 2005055523 | 3/2005 |
| JP | 2005056596 | 3/2005 |
| JP | 2005056738 | 3/2005 |
| JP | 2005-156824 | 6/2005 |
| JP | 2005-300609 | 10/2005 |
| JP | 2006-106414 | 4/2006 |

* cited by examiner

TONER

BACKGROUND OF THE INVENTION

1. Field of the Invention

The present invention relates to a toner to be used in an image forming method including at least: a developing step of developing an electrostatic latent image formed on an electrostatic latent image-bearing member such as an electrophotographic photosensitive member or an electrostatic recording derivative in an electrophotographic method with a developer to form a toner image on the electrostatic latent image-bearing member; a transferring step of electrostatically transferring the toner image formed on the electrostatic latent image-bearing member onto a recording material through or without through an intermediate transfer member; and a fixing step of fixing the toner image on the recording material under heat.

2. Description of the Related Art

An image forming apparatus employing an electrophotographic method which has been widely demanded for an office use purpose and a personal use purpose, and in any one of the markets such as a graphic market and a light printing market in recent years is an image forming system excellent in quick start property and energy saving property.

Accordingly, the mainstream of, in particular, a fixing system has been shifting from a conventional hard roller system having a large heat capacity to a light-pressure fixing system such as film fixation or belt fixation having a small heat capacity from the viewpoint of a reduction in power consumption (see, for example, JP 2005-055523 A and JP 2005-056596 A).

Since such light-pressure fixing system has a small heat capacity, the system can shorten a time period required for the temperature of the system to reach a fixation set temperature (which may hereinafter be referred to as "adjustment temperature"), and is excellent in quick start property. In addition, the system has the following advantage: a fixing unit itself can be reduced in size and weight because the system does not use a thick metal part or multiple heaters unlike a conventional hard roller system.

On the other hand, however, a light-pressure fixing system shows a larger reduction in temperature of the surface of a fixing member upon continuous copying than that in the case of a conventional hard roller system owing to a reduction in heat capacity. In addition, the light-pressure fixing system is apt to reduce the pressure of toner to be applied to a recording material, so a fixing failure is apt to occur.

In contrast, in, for example, film fixation out of the light-pressure fixing systems, a fixing member that sufficiently fixes a toner image on a recording material for preventing a reduction in temperature at a region where the fixing member and a pressurizing member contact with each other (which may hereinafter be referred to as "fixing nip") has been proposed (see, for example, JP 2005-056738 A). However, such light-pressure fixing system is still apt to cause a reduction in temperature of the surface of the fixing member, and a fixation temperature distribution and a fixing pressure distribution at the fixing nip are apt to be nonuniform as compared to a conventional hard roller system. Accordingly, a fixing failure due to the reduction in temperature, or the so-called hot offset phenomenon in which toner adheres to the fixing member at a fixing nip portion having a temperature in excess of an adjustment temperature to contaminate the fixing member, and the contaminated fixing member contaminates the recording material when the fixing member contacts with the recording material again is apt to occur. Various contrivances have been made to prevent such reduction in temperature as described above, and to uniformize such fixation temperature distribution and fixing pressure distribution at a fixing nip portion as described above, but the additional improvement of the contrivances has been requested.

Therefore, each of additionally improved low-temperature fixability and a wide fixation temperature range (which may hereinafter be referred to as "fixation latitude") is performance that has been requested of toner in order that the toner may adapt to not only a conventional hard roller system but also a light-pressure fixing system excellent in energy saving property.

In addition, additional improvements in speed and image quality have been needed in an image forming apparatus employing an electrophotographic method in recent years. However, an improvement in developing ability and an improvement in such low-temperature fixability as described above with a view to corresponding to the high-speed developing system are in a trade-off relationship. For example, in the case of toner placing priority on low-temperature fixability, the molecular weight distribution of a binder resin tends to be made small, or the softening point of the resin tends to be reduced. As a result, detrimental effects such as the deterioration of the toner and the contamination of a developing member at the time of high-speed development are apt to occur. In contrast, in the case of toner placing priority on developing ability, the molecular weight distribution of a binder resin tends to be made large, or the softening point of the binder resin tends to be increased. As a result, the low-temperature fixability of the toner deteriorates, so it becomes difficult to achieve an image forming system excellent in energy saving property.

In view of the foregoing, a high level of compatibility between fixing ability and developing ability has been requested of toner adaptable to a high-speed developing system and a light-pressure fixing system in order to correspond to needs in the market.

Various contrivances have been conventionally made to provide toner for achieving compatibility between fixing ability and developing ability. For example, a large number of toners each using a low-softening-point resin and a high-softening-point resin in combination and each taking advantage of the properties of the respective resins have been proposed. Those toners each aim to achieve compatibility between fixing ability and developing ability while securing a fixation latitude through an improvement in low-temperature fixability of the low-softening-point resin and an improvement in hot offset property of the high-softening-point resin and keeping a balance between the improvements.

Of such proposals, some proposals relate to toners each using two or more kinds of resins in combination and each having the so-called sea-island structure in which a low-softening-point resin is included in the structure of a high-softening-point resin (see, for example, JP 2002-214833 A and JP 2002-244338 A). Those toners are each excellent in that the elution of the low-softening-point resin is controlled, and a fixation latitude is secured. However, an additional improvement in low-temperature fixability is requested in order that each of the toners may adapt to such light-pressure fixing system as described above.

In addition, another proposal concerning toner using a low-softening-point resin and a high-softening-point resin in combination is as follows: the combined use of two or more kinds of resins compatibility between which is good satisfies the low-temperature fixability and storage stability of toner (see, for example, JP 2000-275908 A and JP 2004-085605 A). However, such proposal is still insufficient in terms of the securement of a fixation latitude in the above-mentioned light-pressure fixing system and an improvement in developing ability in a high-speed developing system.

Accordingly, at present, there still remains a problem concerning a high level of compatibility between fixing ability and developing ability.

SUMMARY OF THE INVENTION

An object of the present invention is to provide a toner which: is excellent in fixing ability such as low-temperature fixability, hot offset property, and separability even in a light-pressure fixing system excellent in quick start property and energy saving property and even in a high-speed developing system; has high gloss and high chroma; and is excellent in development stability irrespective of environments.

The object can be achieved by the following components of the present invention.

(1) A toner including toner particles each containing at least a binder resin and a colorant, in which in a case where a tetrahydrofuran (THF) insoluble matter of the binder resin in the toner when the toner is subjected to Soxhlet extraction with THF for 2 hours is represented by A (mass %), a THF insoluble matter of the binder resin in the toner when the toner is subjected to Soxhlet extraction with THF for 4 hours is represented by B (mass %), a THF insoluble matter of the binder resin in the toner when the toner is subjected to Soxhlet extraction with THF for 8 hours is represented by C (mass %), and a THF insoluble matter of the binder resin in the toner when the toner is subjected to Soxhlet extraction with THF for 16 hours is represented by D (mass %), A, B, C, and D satisfy the following expression (1), $$(A-B)/2>(B-C)/4>(C-D)/8 \quad (1)$$

where $40<A\leqq 75$ (mass %) and $1.0<D<40$ (mass %);

(2) a toner according to item (1), in which the toner has a highest endothermic peak at 50 to 110° C. in an endothermic curve in differential scanning calorimetry (DSC);

(3) a toner according to item (1), in which the toner has a storage elastic modulus G' (140° C.) at 140° C. of $1.0\times10^3$ dN/m$^2$ or more to less than $1.0\times10^5$ dN/m$^2$;

(4) a toner according to items (1), in which the toner has an average circularity of 0.945 or more to 0.990 or less, the average circularity being obtained by dividing circularities measured with a flow-type particle image measuring device having an image processing resolution of 512×512 pixels (0.37 μm×0.37 μm per pixel) into 800 sections in a circularity range of 0.200 or more to 1.000 or less and by analyzing the circularities; and (5) a toner according to items (1), in which the binder resins have a low-softening-point resin having a softening point of 80.0° C. or higher to lower than 110.0° C. and having a polyester unit and a vinyl-based copolymer unit, and a high-softening-point resin having a softening point of 110.0° C. or higher to 145.0° C. or lower and having a polyester unit and a vinyl-based copolymer unit.

According to the present invention, an image which: is excellent in fixing ability such as low-temperature fixability, hot offset property, and separability even in a light-pressure fixing system excellent in quick start property and energy saving property and even in a high-speed developing system; and has high gloss and high chroma can be obtained. In addition, the image is excellent in development stability irrespective of environments. In addition, according to the present invention, separability from a fixing member is additionally improved, the occurrence of, for example, the contamination of the fixing member is prevented, and a good image can be obtained over a long time period.

DESCRIPTION OF THE EMBODIMENTS

Figure 1:
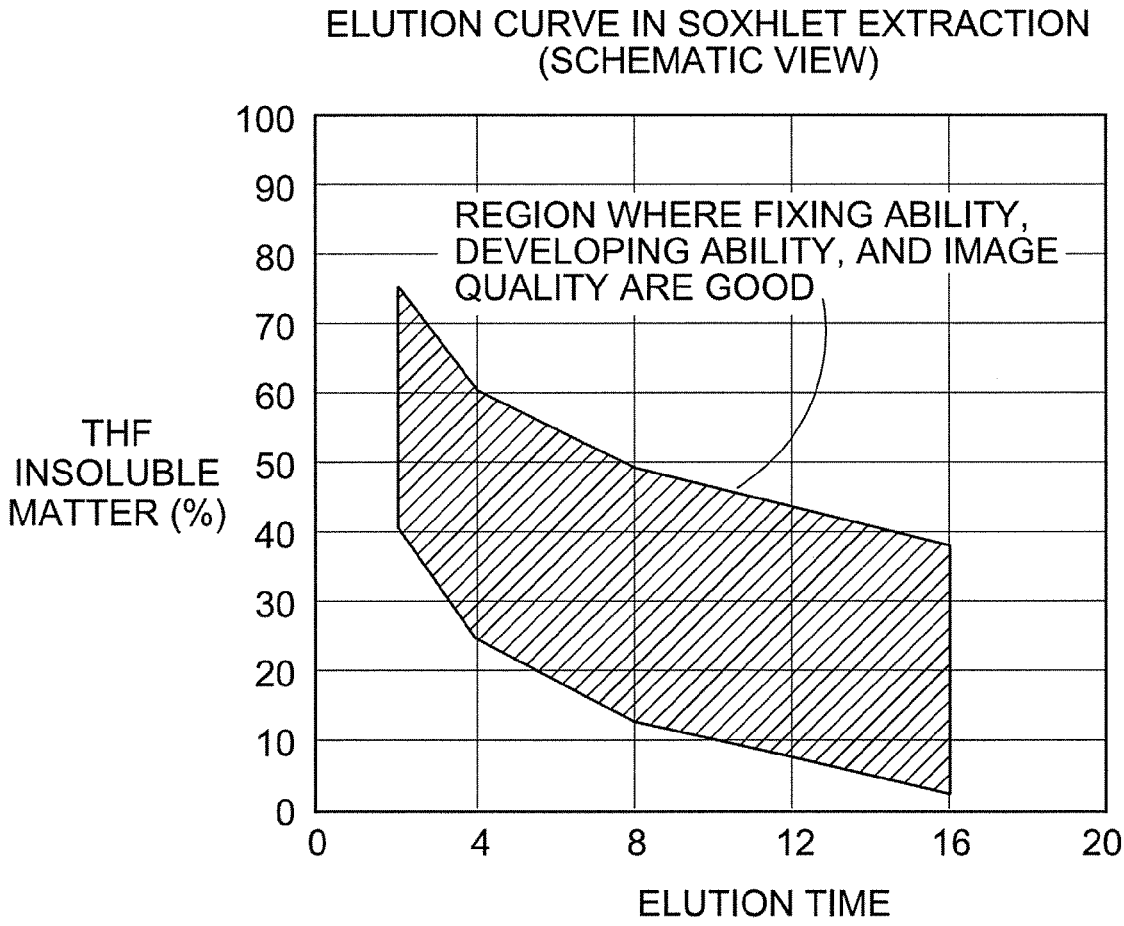
FIG. 1 is a schematic view showing an elution curve in Soxhlet extraction with THF representing an effect in which a toner of the present invention has improved fixing ability.

Hereinafter, the best mode for carrying out the present invention will be described in detail.

First, the physical properties of a toner of the present invention will be described in detail.

(Physical Properties of Toner)

A toner of the present invention includes toner particles each containing at least a binder resin and a colorant, in which in a case where a tetrahydrofuran (THF) insoluble matter of the binder resins in the toner when the toner is subjected to Soxhlet extraction with THF for 2 hours is represented by A (mass %), a THF insoluble matter of the binder resins in the toner when the toner is subjected to Soxhlet extraction with THF for 4 hours is represented by B (mass %), a THF insoluble matter of the binder resins in the toner when the toner is subjected to Soxhlet extraction with THF for 8 hours is represented by C (mass %), and a THF insoluble matter of the binder resins in the toner when the toner is subjected to Soxhlet extraction with THF for 16 hours is represented by D (mass %), A, B, C, and D satisfy the following expression (1):

$$(A-B)/2>(B-C)/4>(C-D)/8 \quad (1)$$

where $40<A\leqq 75$ (mass %) and $1.0<D<40$ (mass %).

When those THF insoluble matters A, B, C, and D (mass %) of the binder resins in the toner satisfy a relational expression represented by the expression (1), a toner capable of achieving an additionally high level of compatibility between fixing ability and developing ability even in both a light-pressure fixing system and a high-speed developing system as an object of the present invention can be provided. A region which satisfies the relational expression represented by the above expression (1) and in which the fixing ability and developing ability of toner are good is shown in an elution curve in Soxhlet extraction in FIG. 1 (schematic view).

First, in the present invention, as shown in FIG. 1, it is important for the elution curve in Soxhlet extraction to satisfy the relational expression represented by the expression (1). When the elution curve satisfies the relational expression represented by the expression (1), a binder resin in the toner is quickly eluted in a low-temperature region at the time of fixation, and the elution of the binder resin in the toner in a high-temperature region at the time of the fixation is suppressed, whereby good low-temperature fixability and a wide fixation latitude can be secured.

When the elution curve is a curve which satisfies, for example, a relational expression represented by the following expression (2) (when the curve does not satisfy the relational expression represented by the expression (1)), a binder resin in the toner is slowly eluted in the low-temperature region at the time of the fixation, and the binder resin in the toner is quickly eluted in the high-temperature region, with the result that both low-temperature fixability and a fixation latitude deteriorate.

$$(A-B)/2<(B-C)/4<(C-D)/8 \quad (2)$$

In addition, when the elution curve is a linear line which does not satisfy the relational expression represented by the expression (1), and its gradient has a large absolute value, a binder resin in the toner is quickly eluted in the low-temperature region, but the binder resin is quickly eluted also in the high-temperature region, with the result that a fixation latitude becomes extremely narrow, though good low-temperature fixability is obtained.

In contrast, when the elution curve is a linear line which does not satisfy the relational expression represented by the expression (1), and its gradient has a small absolute value, a binder resin in the toner is slowly eluted in the high-temperature region, but the binder resin is slowly eluted also in the low-temperature region, with the result that a fixation latitude shifts toward the high-temperature region.

As described above, an effect of the present invention can be sufficiently exerted when the elution curve of the binder resins in the toner satisfies the relational expression represented by the expression (1) in order that good low-temperature fixability and a fixation latitude may be secured. The foregoing toner physical property is preferable particularly in such low-temperature fixing system excellent in energy saving property as described above.

In addition, in the present invention, it is important for the elution curve in Soxhlet extraction to satisfy the relational expression represented by the expression (1) as shown in FIG. 1 in order that a high level of compatibility between fixing ability and developing ability may be achieved. In addition, in this case, an image having high gloss and high chroma can be obtained over a long time period.

When the THF insoluble matter A (mass %) is 40 (mass %) or less, good low-temperature fixability, and an image having high gloss and high chroma can be obtained, but toner is apt to deteriorate, and a developing member is apt to be contaminated at the time of high-speed development. When the THF insoluble matter A (mass %) exceeds 75 (mass %), good developing ability can be obtained even at the time of high-speed development, but low-temperature fixability, gloss, and chroma are apt to be insufficient.

In addition, when the THF insoluble matter D (mass %) is 1.0 (mass %) or less, good low-temperature fixability can be obtained, but a hot offset phenomenon is apt to occur in a high-temperature region. When the THF insoluble matter D (mass %) is 40 (mass %) or more, good hot offset property can be obtained, but low-temperature fixability is apt to be insufficient, and, in the case of toner produced by a pulverization method, the grindability of the toner deteriorates, so productivity is apt to deteriorate.

As described above, the effect of the present invention can be sufficiently exerted when the elution curve in Soxhlet extraction satisfies the relational expression represented by the expression (1) as shown in FIG. 1 in order that a high level of compatibility between fixing ability and developing ability may be achieved. Toner preferably has the foregoing physical property so as to adapt to, in particular, such light-pressure fixing system and high-speed developing system as described above.

The toner of the present invention preferably has a highest endothermic peak at 50 to 110° C. in an endothermic curve in differential scanning calorimetry (DSC).

When the highest endothermic peak of the toner is placed in the range, the above-mentioned good fixability can be obtained, and an improvement in developing ability can be promoted. First, separability between a fixing member and the toner is additionally improved, and the occurrence of, for example, the contamination of the fixing member can be prevented, whereby a good image can be obtained over a long time period. When such light-pressure fixing system as described above is used particularly at high temperature and high humidity, a fixation temperature distribution and a fixing pressure distribution at a fixing nip become nonuniform, so the separability from the fixing member tends to deteriorate. In view of the foregoing, when the highest endothermic peak of the toner is placed at 50 to 110° C., the releasing action of the toner in the fixing nip is improved, whereby the separability can be improved irrespective of the temperature distribution and the pressure distribution. When the highest endothermic peak of the toner is placed at lower than 50° C., good separability can be obtained, but the storage stability of the toner deteriorates, or the deterioration of the toner or the contamination of the developing member becomes remarkable at the time of high-speed development. When the highest endothermic peak of the toner is placed at higher than 110° C., good separability cannot be obtained, and a recording material is wound around the fixing member, or the contamination of the fixing member or the like occurs in some cases.

A toner having THF insoluble matters A, B, C, and D (mass %) satisfying the above expression (1) can be obtained by appropriately adjusting, for example, a resin. In addition, a toner having the above highest endothermic peak by DSC can be obtained by appropriately adjusting, for example, a wax.

In addition, the toner of the present invention preferably has a storage elastic modulus G' (140° C.) at 140° C. of $1.0\times10^3$ dN/m$^2$ or more to less than $1.0\times10^5$ dN/m$^2$.

When the storage elastic modulus G' (140° C.) of the toner falls within the range, the above-mentioned good fixing ability can be obtained, and an improvement in developability can be promoted. When the storage elastic modulus G' (140° C.) of the toner is less than $1.0\times10^3$ dN/m$^2$, good low-temperature fixability can be obtained because the viscosity of the toner reduces, but hot offset property and the storage stability of the toner become insufficient in a high-temperature region. Further, the deterioration of the toner or the contamination of a developing member is apt to occur at the time of high-speed development. When the storage elastic modulus G' (140° C.) of the toner exceeds $1.0\times10^5$ dN/m$^2$, good hot offset property can be obtained because the elasticity of the toner increases, but low-temperature fixability is apt to be insufficient, and, in the case where the toner is produced by a pulverization method, the grindability of the toner deteriorates, so productivity is apt to deteriorate.

It should be noted that the storage elastic modulus G' (140° C.) can satisfy the above condition by adjusting the composition, softening point, and molecular weight distribution of each of a low-softening-point resin and a high-softening-point resin to be described later, a compounding ratio between the resins, and the addition amount of a charge control agent to be crosslinked at the time of the kneading of a binder resin.

In addition, the toner of the present invention preferably has an average circularity of 0.945 or more to 0.990 or less, the average circularity being obtained by dividing circularities measured with a flow-type particle image measuring device having an image processing resolution of 512×512 pixels (0.37 μm×0.37 μm per pixel) into 800 sections in a circularity range of 0.200 or more to 1.000 or less and by analyzing the circularities.

When the average circularity of the toner falls within the range, the above-mentioned good fixing ability can be obtained, and an improvement in developing ability can be promoted. When the average circularity of the toner is less than 0.945, the triboelectric charging of the toner is apt to be nonuniform, so developing ability is also apt to be insufficient, and transfer efficiency is also apt to be insufficient. When the average circularity of the toner exceeds 0.990, the triboelectric charging of the toner becomes uniform, and hence good developing ability and good transfer efficiency can be obtained, but the fluidity of the toner becomes so high that the scattering or the like of the toner occurs at the time of transfer to be responsible for an image failure in some cases.

It should be noted that the average circularity of the toner can satisfy the above condition by adjusting conditions for pulverization with a pulverizing apparatus to be described later and conditions for modification with a surface modification apparatus to be described later.

Next, the constitution of a material that can be used in the toner of the present invention will be described in detail.

(Material Constitution of Toner)

A binder resin that can be used in the present invention may be any known resin; a resin having a polyester unit is preferably used as the binder resin. Examples of a resin having a polyester unit include (a) a polyester resin, (b) a hybrid resin having a polyester unit and a vinyl-based copolymer unit, (c) a mixture of a hybrid resin and a vinyl-based copolymer, (d) a mixture of a polyester resin and a vinyl-based copolymer, (e) a mixture of a hybrid resin and a polyester resin, and (f) a mixture of a polyester resin, a hybrid resin, and a vinyl-based copolymer. Of those, a hybrid resin is preferable in order that the effect of the present invention may be obtained.

When a polyester resin is used as a binder resin, a polyhydric alcohol, and a polycarboxylic acid, a polycarboxylic anhydride, a polycarboxylate, or the like can be used as raw material monomers. In addition, the same holds true for a monomer to be used in the production of a polyester unit in a hybrid resin.

Specific examples of a dihydric alcohol component include: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Examples of the alcohol component that has three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanctriol, 2-methyl-1,2,4-butanetriol, trimethylolethane, trimethylolpropane, and 1,3,5-trihydroxymethylbenzene.

Examples of the dihydric acid component include: aromatic dicarboxylic acids such as phthalic acid, isophthalic acid, and terephthalic acid, and anhydrides thereof; alkyldicarboxylic acids such as succinic acid, adipic acid, sebacic acid, and azelaic acid, and anhydrides thereof; succinic acids substituted by an alkyl group having 6 to 12 carbon atoms, and anhydrides thereof; and unsaturated dicarboxylic acids such as fumaric acid, maleic acid, and citraconic acid, and anhydrides thereof.

In addition, examples of a polyvalent carboxylic acid component which is trivalent or more for forming a polyester resin having a crosslinked site include 1,2,4-benzenetricarboxylic acid, 1,2,5-benzenetricarboxylic acid, 1,2,4-naphthalenetricarboxylic acid, 2,5,7-naphthalenetricarboxylic acid, and 1,2,4,5-benzenetetracarboxylic acid, and anhydrides and ester compounds of these acids.

Of those, in particular, a polyester resin obtained by subjecting a bisphenol derivative having a structure represented by the following formula (i) as a polyhydric alcohol component and a carboxylic acid component composed of a carboxylic acid which is divalent or more, or of an anhydride or lower alkyl ester of the acid (such as fumaric acid, maleic acid, maleic anhydride, phthalic acid, terephthalic acid, trimellitic acid, or pyromellitic acid) as an acid component to condensation polymerization is preferable because the resin has good charging property:

(i)

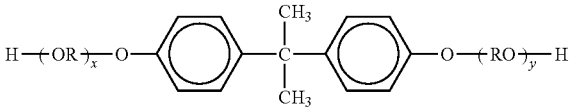

where R represents an ethylene or propylene group, x and y each represent an integer of 1 or more, and the average value of x+y is 2 to 10.

The "hybrid resin" as a binder resin to be incorporated into the toner of the present invention means a resin in which a vinyl-based polymer unit and a polyester unit are chemically bonded to each other. To be specific, the hybrid resin is a resin formed by an ester exchange reaction between a polyester unit and a vinyl-based polymer unit obtained by polymerizing a monomer having a carboxylate group such as a methacrylate; the hybrid resin is preferably a graft copolymer (or block copolymer) using a vinyl-based polymer as a stem polymer and a polyester unit as a branch polymer. It should be noted that the term "polyester unit" as used in the present invention refers to a portion originating from polyester, and the term "vinyl-based polymer unit" as used in the present invention refers to a portion originating from a vinyl-based polymer. Polyester-based monomers of which a polyester unit is constituted are a polycarboxylic acid component and a polyhydric alcohol component, and a vinyl-based polymer unit is a monomer component having a vinyl group.

Examples of a vinyl-based monomers for producing vinyl-based copolymer or vinyl-based polymer units include: styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butylmethacrylate, isobutylmethacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylate esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

Further, unsaturated dihydric acids such as maleic acid, citraconic acid, itaconic acid, alkenylsuccinic acid, fumaric acid, and mesaconic acid; unsaturated dihydric acid anhydrides such as maleic anhydride, citraconic anhydride, itaconic anhydride, and alkenylsuccinic anhydride; unsaturated dihydric acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dihydric acid esters such as dimethyl maleate and dimethyl fumarate; α,β-unsaturated acids such as acrylic acid, methacrylic acid, crotonic acid, and cinnamic acid; anhydrides of α,β-unsaturated acids such as crotonic anhydride and cinnamic anhydride; anhydrides of the above-mentioned α,β-unsaturated acids and lower aliphatic acids; and monomers having a carboxyl group such as alkenylmalonic acid, alkenylglutaric acid, and alkenyladipic acid, acid anhydrides thereof, and monoesters thereof.

Further, acrylate esters or methacrylate esters such as 2-hydroxyethyl acrylate, 2-hydroxyethyl methacrylate, and 2-hydroxypropyl methacrylate; and monomers having hydroxy groups such as 4-(1-hydroxy-1-methylbutyl) styrene and 4-(1-hydroxy-1-methylhexyl)styrene.

In the toner of the present invention, vinyl copolymers and vinyl polymer units of the binding resins may have a crosslinking structure crosslinked with a crosslinking agent having two or more vinyl groups.

In this case, examples of the crosslinking agent to be used include aromatic divinyl compounds such as divinylbenzene and divinylnaphthalene; diacrylate compounds bonded together with an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylate of each of the above-mentioned compounds to methacrylate; diacrylate compounds bonded together with an alkyl chain containing an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylate of each of the above-mentioned compounds to methacrylate; and diacrylate compounds bonded together with a chain containing an aromatic group and an ether bond, such as polyoxyethylene(2)-2,2-bis(4-hydroxyphenyl)propane diacrylate, polyoxyethylene(4)-2,2-bis(4-hydroxyphenyl)propane diacrylate, and those obtained by changing the acrylate of each of the above-mentioned compounds to methacrylate.

Examples of the polyfunctional crosslinking agents include: pentaerythritol triacrylate, trimethylolethane triacrylate, trimethylolpropane triacrylate, tetramethylolmethane tetraacrylate, oligoester acrylate, and those obtained by changing the acrylate of the above-mentioned compounds to methacrylate; triallyl cyanurate, and triallyl trimellitate.

When manufacturing a hybrid resin, it is preferable that the vinyl-based polymer unit and the polyester unit each or both contain a monomer component capable of reacting with both resin unit compounds. Of the monomers components constituting the polyester unit, examples of monomer components capable of reacting with the vinyl-based polymer unit include unsaturated dicarboxylic acids such as fumaric acid, maleic acid, citraconic acid, and itaconic acid, and anhydrides thereof. Of the monomer components constituting the vinyl-based polymer unit, examples of monomer components capable of reacting with the polyester unit include a compound having a carboxyl group or a hydroxyl group, acrylates, and methacrylates.

A preferable method of obtaining a product of a reaction between a vinyl-based polymer unit and a polyester unit involves performing the polymerization reaction of one or both of the resins in the presence of a polymer containing a monomer component capable of reacting with each of the vinyl-based polymer unit and the polyester unit described above.

Examples of the polymerization initiators used for producing vinyl-based copolymers or vinyl-based polymer units include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis (2-methyl-propane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butylperoxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexylperoxydicarbonate, di-n-propylperoxydicarbonate, di-2-ethoxyethylperoxycarbonate, di-methoxyisopropyl peroxydicarbonate, di(3-methyl-3-methoxybutyl)peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butylperoxyisophthalate, t-butyl peroxyallylcarbonate, t-amyl peroxy-2-ethylhexanoate, di-t-butylperoxyhexahydroterephthalate, and di-t-butylperoxyazelate.

Examples of a method of producing the hybrid resin in the toner of the present invention include the production methods shown in the following (1) to (5).

(1) A method of producing a hybrid resin, including: separately producing a vinyl-based polymer and a polyester resin; dissolving and swelling the vinyl-based polymer and the polyester resin in a small amount of organic solvent; adding an esterification catalyst and alcohol to the solution; and heating the mixture to carry out an ester exchange reaction.

(2) A method of producing a hybrid resin having a polyester resin component and a vinyl-based resin component, including: producing a vinyl-based polymer at first; and then in the presence of the vinyl polymer, reacting a polyester resin component. The hybrid resin component is produced by reacting a vinyl-based polymer unit (if required, vinyl-based monomers may be added) with polyester monomers (polyhydric alcohol or polycarboxylic acid) or by reacting above-mentioned unit and monomer with necessarily added polyester. In this case, any appropriate organic solvent may be used.

(3) A method of producing a hybrid resin having a polyester resin component and a vinyl-based resin component, including: producing a polyester resin; and then, in the presence of the polyester resin, reacting a vinyl-based resin component. The hybrid resin component is produced by reacting a polyester unit (if required, polyester monomers may be added) with vinyl-based monomers or by reacting above-mentioned unit and monomer with necessarily added vinyl-based polymer unit. In this case, any appropriate organic solvent may also be used.

(4) A method of producing a hybrid resin component, including: producing a vinyl-based polymer and a polyester resin; and then in the presence of those polymer units, adding each or both of vinyl-based monomers and polyester monomers (polyhydric alcohol or polycarboxylic acid); and performing polymerization under the condition according to the monomers added. In this case, any appropriate organic solvent may also be used.

(5) A method of producing the vinyl-based polymer unit, the polyester unit, and the hybrid resin component, including: mixing vinyl-based monomers and polyester monomers (polyhydric alcohol or polycarboxylic acid); and performing serial of addition polymerization reaction and condensation polymerization reaction. Further, any appropriate organic solvent may be used.

In the above production methods (1) to (5), multiple polymer units different from each other in molecular weight or in degree of crosslinking can be used for the vinyl-based polymer unit and the polyester unit.

It should be noted that the term "vinyl-based polymer" as used in the present invention means a vinyl-based homopolymer or a vinyl-based copolymer, and the term "vinyl-based polymer unit" as used in the present invention means a vinyl-based homopolymer unit or a vinyl-based copolymer unit.

Two or more kinds of such binder resins as described above are preferably used in the toner of the present invention. With regard to the physical properties of the binder resins, binder resins different from each other in softening point are particularly preferably used.

The term "softening point" as used in the present invention refers to a 1/2 method temperature measured with a koka type flow tester on the basis of JISK 7210. A specific measurement method will be described later. A low-softening-point resin and a high-softening-point resin are preferably used as binder resins different from each other in softening point. The low-softening-point resin has a softening point of preferably 80.0° C. or higher to lower than 110.0° C., or more preferably 80.0° C. or higher to lower than 95.0° C. The high-softening-point resin has a softening point of preferably 110.0° C. or higher to 145.0° C. or lower, or more preferably 130.0° C. or higher to 145.0° C. or lower. In addition, each of the low-softening-point resin and the high-softening-point resin preferably contain at least a hybrid resin. The combined use of the low-softening-point resin and the high-softening-point resin as described above can quicken the elution of the binder resins in the toner in a low-temperature region, and can retard the elution of the binder resins in the toner in a high-temperature region. That is, good low-temperature fixability and a fixation latitude can be secured.

It should be noted that the softening point of a binder resin can satisfy the above condition by adjusting the composition of the binder resin and the conditions under which the resin is polymerized at the time of polymerization.

A hybrid resin that can be incorporated into the low-softening-point resin is such that a composition ratio of a polyester unit to a vinyl-based polymer unit (the number of polyester units/the number of vinyl-based polymer units) is in the range of preferably 60/40 to 95/5, or more preferably 70/30 to 95/5. A hybrid resin that can be incorporated into the high-softening-point resin is such that a composition ratio of a polyester unit to a vinyl-based polymer unit (the number of polyester units/the number of vinyl-based polymer units) is in the range of preferably 50/50 to 90/10, or more preferably 60/40 to 90/10. Further, the composition ratio of the polyester unit of the low-softening-point resin is preferably larger than the composition ratio of the polyester unit of the high-softening-point resin. This is because the efficiency with which low-temperature fixability is improved can increase with increasing composition ratio of the polyester unit in the low-softening-point resin. The reason for the foregoing is unclear, but one possible reason is as follows: when the low-softening-point resin and the high-softening-point resin have the same composition, compatibility between both the binder resins becomes good, and the two kinds of binder resins in the toner are dispersed in an ultra-fine manner, so the resins cannot act on a function-sharing basis in the low-temperature region and the high-temperature region described above.

In addition, a compounding ratio between the low-softening-point resin and the high-softening-point resin that can be used in the toner of the present invention (the mass of the low-softening-point resin/the mass of the high-softening-point resin) is in the range of preferably 50/50 to 90/10. This is because the elution of the binder resins in the toner in the low-temperature region can be easily controlled when a compounding ratio of the low-softening-point resin to the high-softening-point resin is larger than 1/1.

The low-softening-point resin that can be used in the present invention has a main peak in a molecular weight region of 1,000 to 10,000, or preferably in a molecular weight region of 2,000 to 6,000 in a molecular weight distribution measured by gel permeation chromatography (GPC). Further, a ratio of the weight average molecular weight (Mw) of the low-softening-point resin to the number average molecular weight (Mn) of the resin is preferably 2.0 or more to 40 or less.

When the low-softening-point resin has a main peak in a molecular weight region of less than 1,000, the storage stability of the toner tends to deteriorate. On the other hand, when the low-softening-point resin has a main peak in a molecular weight region in excess of 10,000, the low-temperature fixability, gloss, and chroma of the toner tend to reduce so as to be insufficient. In addition, when the ratio Mw/Mn of the low-softening-point resin is less than 2.0, the storage stability of the toner tends to deteriorate. When the ratio Mw/Mn of the low-softening-point resin exceeds 40, the toner may be unable to obtain sufficient low-temperature fixability.

In addition, the high-softening-point resin that can be used in the present invention has a main peak in a molecular weight region of 5,000 to 15,000, or preferably in a molecular weight region of 6,000 to 12,000 in a molecular weight distribution measured by gel permeation chromatography (GPC). Further, a ratio of the weight average molecular weight (Mw) of the high-softening-point resin to the number average molecular weight (Mn) of the resin is preferably 40 or more to 400 or less.

When the high-softening-point resin has a main peak in a molecular weight region of less than 5,000, the hot offset property of the toner tends to deteriorate. On the other hand, when the high-softening-point resin has a main peak in a molecular weight region in excess of 15,000, the low-temperature fixability, gloss, and chroma of the toner tend to reduce so as to be insufficient. In addition, when the ratio Mw/Mn of the high-softening-point resin is less than 40, the hot offset property of the toner tends to deteriorate. When the ratio Mw/Mn of the high-softening-point resin exceeds 400, the gloss and chroma of the toner may reduce so as to be insufficient.

In addition, when the toner of the present invention is used in an oilless fixing unit having no oil applying mechanism, the toner preferably contains a wax as a release agent from the viewpoint of an improvement in fixing ability.

Examples of the wax which can be used in the present invention include the following: aliphatic hydrocarbon wax such as a low molecular weight polyethylene, a low molecular weight polypropylene, an alkylene copolymer, a microcrystalline wax, a paraffin wax, and a Fischer-Tropsch wax; an aliphatic hydrocarbon wax oxide such as a polyethylene oxide wax or block copolymers of aliphatic hydrocarbon waxes; a wax containing an alphatic ester as a main component such as a carnauba wax, behenic acid behenyl, and a montanate wax; and a wax containing an alphatic ester deoxidated partially or totally such as a deoxidated carnauba wax. Further, examples of the wax include: linear saturated alphatic acids such as palmitic acid, stearic acid, and montan acid; unsaturated alphatic acids such as brassidic acid, eleostearic acid, and barinarin acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of alphatic acids such as palmitic acid, stearic acid, behenic acid, and montan acid and alcohols such as stearyl alcohol, aralkyl alcohol, behenyl alcohol, carnaubyl alcohol, ceryl alcohol, and melissyl alcohol; alphatic amides such as linoleic amide, oleic amide, and lauric amide; saturated alphatic bis amides such as methylenebis stearamide, ethylene bis capramide, ethylene bis lauramide, and hexamethylene bis stearamide; unsaturated alphatic amides such as ethylene bis oleamide, hexamethylene bis oleamide, N,N'-dioleyl adipamide, and N,N'-dioleyl sebacamide; aromatic bis amides such as m-xylene bis stearamide and N—N'-distearyl isophthalamide; alphatic acid metallic salts (generally called metallic soaps) such as calcium stearate, calcium laurate, zinc stearate, and magnesium stearate; graft waxes in which aliphatic hydrocarbon waxes are grafted with vinyl-based monomers such as styrene and acrylic acid; partially esterified compounds of alphatic acids and polyalcohols such as behenic monoglyceride; and methyl ester compounds having hydroxyl groups obtained by hydrogenation of vegetable oil.

Examples of a wax that can be particularly preferably used in the present invention include an aliphatic hydrocarbon-based wax, and an esterified compound as an ester of an aliphatic acid and an alcohol. Desirable examples of the foregoing include: a low-molecular-weight alkylene polymer obtained by subjecting an alkylene to radical polymerization under high pressure or by polymerizing an alkylene under reduced pressure by using a Ziegler catalyst or a metallocene catalyst; an alkylene polymer obtained by the thermal decomposition of a high-molecular-weight alkylene polymer; and a synthetic hydrocarbon wax obtained from a residue on distillation of a hydrocarbon obtained by an Age method from a synthetic gas containing carbon monoxide and hydrogen, and a synthetic hydrocarbon wax obtained by the hydrogenation of the gas. Further, a product obtained by fractionating such hydrocarbon wax by employing a press sweating method, a solvent method, a utilization of vacuum distillation, or a fractional crystallization mode is more preferably used. A hydrocarbon synthesized by a reaction between carbon monoxide and hydrogen using a metal oxide-based catalyst (a multiple system composed of two or more kinds of elements in many cases) [such as a hydrocarbon compound synthesized by a synthol method or a hydrocol method (involving the use of a fluid catalyst bed), a hydrocarbon having up to several hundreds of carbon atoms obtained by an Age method (involving the use of an identification catalyst bed) with which a large amount of a wax-like hydrocarbon can be obtained, or a hydrocarbon obtained by polymerizing an alkylene such as ethylene by using a Ziegler catalyst is preferably used as a hydrocarbon as the parent body of such aliphatic hydrocarbon wax because each of the hydrocarbons is a saturated, long, linear hydrocarbon with a small number of small branches. A wax synthesized by a method not involving the polymerization of an alkylene is particularly preferable because of its molecular weight distribution. A paraffin wax is also preferably used.

In addition, the toner of the present invention preferably has a highest endothermic peak at 50 to 110° C. in the temperature range of 30 to 200° C. in an endothermic curve in differential scanning calorimetry (DSC). When the highest endothermic peak is placed at a temperature of lower than 50° C., the storage stability of the toner tends to deteriorate. In contrast, when the highest endothermic peak is placed at a temperature in excess of 110° C., the fixing ability of the toner tends to deteriorate.

In addition, the wax that can be used in the present invention is preferably turned into a master batch as a wax dispersant.

(i) A polyester resin, (ii) a wax, and (iii) a copolymer having at least a copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer, and polyolefin are particularly preferably used in the wax dispersant.

Because compatibility between a binder resin having a polyester unit that can be used in the present invention and a hydrocarbon-based wax that can be used in the present invention is originally low, when the resin and the wax are added as they are to be turned into toner, the wax segregates in the toner, and a liberated wax or the like is generated. As a result, the deterioration of the toner and the contamination of a developing member at the time of high-speed development are apt to occur.

In view of the foregoing, a resin composition is produced by finely dispersing (ii) the wax in (iii) the copolymer obtained by grafting the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer, and the polyolefin. The resin composition is regarded as a wax dispersant, and the wax dispersant is melted and mixed as a master batch in (i) the polyester resin so that a "wax dispersant master batch" is obtained. The wax dispersant master batch is preferably added and used at the time of toner production.

Examples of monomer which can be used to synthesize copolymer by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer include the followings.

The styrene-based monomer includes, for example: styrenes such as styrene, o-methylstyrene, m-methylstyrene, p-methylstyrene, p-methoxystyrene, p-phenylstyrene, p-chlorostyrene, 3,4-dichlorostyreme, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; and derivatives thereof.

Examples of a nitrogen atom-containing vinyl-based monomer include: amino acid-containing α-methylene aliphatic monocarboxylate ester such as dimethylaminoethyl methacrylate and diethylaminoethyl methacrylate; and derivative of acrylic acid or methacrylic acid such as acrylonitrile, methacrylonitrile, and acrylamide.

Examples of a carboxyl group-containing monomer include: unsaturated dihydric acids such as maleic acid, citraconic acid, itaconic acid, alkenylsuccinic acid, fumaric acid, and mesaconic acid; unsaturated dihydric acid anhydrides such as maleic anhydride, citraconic anhydride, itaconic anhydride, and alkenylsuccinic anhydride; unsaturated dihydric acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dihydric acid esters such as dimethyl maleate and dimethyl fumarate; α,β-unsaturated acids such as acrylic acid, methacrylic acid, crotonic acid, and cinnamic acid anhydrides of α,β-unsaturated acids such as crotonic acid anhydride and cinnamic acid anhydride, and anhydrides of the above-mentioned α,β-unsaturated acids and lower aliphatic acids; and alkenylmalonic acid, alkenylglutaric acid, and alkenyladipic acid, and acid anhydrides thereof and monoesters thereof.

Examples of hydroxyl group-containing monomers include: acrylic esters or methacrylic esters such as 2-hydroxyethyl acrylate, 2-hydroxyethylmethacrylate, and 2-hydroxylpropyl methacrylate; and 4-(1-hydroxy-1-methylbutyl)styrene and 4-(1-hydroxy-1-methylhexyl)styrene.

Example of an acrylate monomer includes acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate.

Example of a methacrylate monomer includes an α-methylene aliphatic monocarboxylate such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethyl aminoethyl methacrylate.

Of those, a tertiary copolymer composed of styrene, acrylonitrile, and butyl acrylate is particularly preferable.

In the molecular weight distribution of the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer by GPC, a weight average molecular weight (Mw) is desirably in the range of 5,000 to 100,000, a number average molecular weight (Mn) is desirably in the range of 1,500 to 15,000, and a ratio (Mw/Mn) of the weight average molecular weight (Mw) to the number average molecular weight (Mn) is desirably in the range of 2 to 40.

When the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer has a weight average molecular weight (Mw) of less than 5,000, has a number average molecular weight (Mn) of less than 1,500, or has a ratio (Mw/Mn) of the weight average molecular weight (Mw) to the number average molecular weight (Mn) of less than 2, the storage stability of the toner is remarkably impaired.

When the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer has a weight average molecular weight (Mw) in excess of 100,000, has a number average molecular weight (Mn) in excess of 15,000, or has a ratio (Mw/Mn) of the weight average molecular weight (Mw) to the number average molecular weight (Mn) in excess of 40, the wax finely dispersed in the wax dispersant cannot rapidly migrate to the surface of molten toner at the time of fixation and melting, so good separability as an effect of the toner of the present invention cannot be obtained.

In addition, the content of the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer in the toner is preferably 0.1 to 20 mass % with respect to the mass of the toner.

When the content of the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer exceeds 20 mass % with respect to the mass of the toner of the present invention, the low-temperature fixability of the toner may be impaired. In addition, when the content is less than 0.1 mass %, a dispersing effect on the wax may be reduced.

The polyolefin to be used in graft polymerization with the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer desirably has the highest endothermic peak at 90 to 130° C. in an endothermic curve at the time of temperature increase measured by DSC.

When the highest endothermic peak of the polyolefin shows a local maximum value at lower than 90° C. or in excess of 130° C., a branched structure in the graft copolymer of the polyolefin with the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer is damaged, so the wax is not finely dispersed, the wax segregates at the time of the production of the toner, and a development failure is apt to occur.

The polyolefin to be incorporated into the wax dispersant in the present invention preferably has a weight average molecular weight (Mw) of 500 to 30,000, a number average molecular weight (Mn) of 500 to 3,000, and a ratio (Mw/Mn) of the weight average molecular weight (Mw) to the number average molecular weight (Mn) of 1.0 to 20 in a molecular weight distribution by GPC, and preferably has a density of 0.9 to 0.95.

When the polyolefin has a weight average molecular weight (Mw) of less than 500, has a number average molecular weight (Mn) of less than 500, has a ratio (Mw/Mn) of the weight average molecular weight (Mw) to the number average molecular weight (Mn) of less than 1.0, has a weight average molecular weight (Mw) in excess of 30,000, has a number average molecular weight (Mn) in excess of 3,000, or has a ratio (Mw/Mn) of the weight average molecular weight (Mw) to the number average molecular weight (Mn) in excess of 20, an improving effect on separability is hardly obtained because the wax finely dispersed in the wax dispersant does not effectively exude to the surface of the toner at the time of fixation. In addition, when the polyolefin has a density in excess of 0.95 (the density of the polyolefin is not low), an effective branched structure in the graft copolymer of the polyolefin with the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer is damaged, so the wax segregates at the time of the production of the toner, and a development failure is apt to occur.

In addition, the content of the polyolefin in the toner is preferably 0.1 to 2 mass % with respect to the mass of the toner.

When the content of the polyolefin exceeds 2 mass % with respect to the mass of the toner, as in the case of the above-mentioned result, the effective branched structure in the graft copolymer of the polyolefin with the copolymer synthesized by using a styrene-based monomer and at least one kind of a monomer selected from a nitrogen atom-containing vinyl monomer, a carboxyl group-containing monomer, a hydroxyl group-containing monomer, an acrylate monomer, and a methacrylate monomer is damaged, so the wax is not finely dispersed, the wax segregates at the time of the production of the toner, and a development failure occurs. In addition, when the content is less than 0.1 mass %, a dispersing effect on the wax may be reduced.

At least one of a known dye and/or a known pigment is used as a colorant in the toner of the present invention.

As a magenta toner pigment, a condensed azo compound, a diketopyrrolopyrrole compound, anthraquinone, a quinacridone compound, a lake compound of basic dyes, a naphthol compound, a benzimidazolone compound, a thioindigo compound, a perylene compound, and the like may be exemplified. Specific examples thereof include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, and 254; C.I. Pigment Violet 19; and C.I. Pigment Vat Red 1, 2, 10, 13, 15, 23, 29, and 35.

Examples of the magenta toner dye include: oil-soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of a cyan toner pigment include: C.I. Pigment Blue 1, 2, 3, 7, 15:2, 15:3, 15:4, 16, 17, 60, 62, and 66; C.I. Vat Blue 6; C.I. Acid Blue 45; and copper-phthalocyanine pigment which phthalocyanine skeleton is substituted with 1 to 5 phthalimide methyl groups having a structure as shown in the following formula (ii).

(ii)

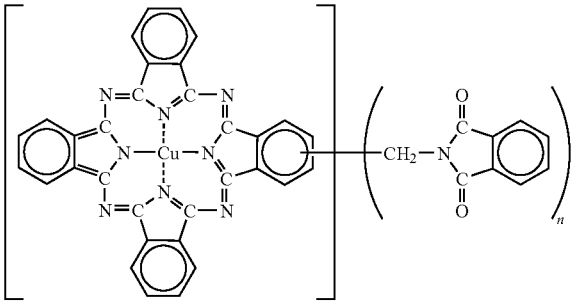

As an yellow pigment, a condensed azo compound, an isoindolinone compound, an anthraquinone compound, azo metallic compound, a methine compound, or an allylamide compound may be exemplified. Specific examples thereof include C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191; and C.I. Vat Yellow 1, 3, and 20. Further, dyes such as C.I. Direct Green 6, C.I. Basic Green 4, C.I. Basic Green 6, and Solvent Yellow 162 can also be used as the colorant.

Examples of a black colorant that may be used in the present invention include carbon black, iron oxide particle and a colorant toned to have a black color by using the above yellow/magenta/cyan colorants.

The colorant is used in the toner in an amount of preferably 0.1 to 20 parts by mass, or more preferably 1.0 to 16 parts by mass with respect to 100 parts by mass of the binder resins in terms of color reproducibility and developing ability.

In addition, in the toner of the present invention, a master batch obtained by mixing a binder resin with the colorant in advance is preferably used. In addition, the colorant can be favorably dispersed in the toner by melting and kneading the colorant master batch and other raw materials (such as the binder resins and the wax).

When a master batch is obtained by using the binder resin and the colorant, the property with which the colorant is dispersed in the toner is improved, and an image having high chroma can be obtained. In addition, color reproducibility such as color mixing property or transparency upon image formation by the fixation of multiple color toners becomes excellent.

Such binder resin for toner suitable for the present invention as described above is preferably used as a binder resin for turning the colorant to be used in the toner of the present invention into a master batch. A middle-softening-point resin having a softening point of preferably 90.0° C. or higher to 130.0° C. or lower (more preferably 95.0° C. or higher to 120.0° C. or lower, or still more preferably 100° C. or higher to 120° C. or lower) is used as the binder resin to be used at the time of the production of the master batch. In addition, the middle-softening-point resin preferably further contains at least a hybrid resin. When a low-softening-point resin and a high-softening-point resin are used as binder resins in combination in the toner of the present invention, the middle-softening-point resin to be used at the time of the production of the master batch preferably has a softening point in excess of the softening point of the low-softening-point resin and lower than the softening point of the high-softening-point resin because the property with which the colorant is dispersed in the toner becomes good. When the softening point of the middle-softening-point resin to be used at the time of the production of the master batch is equal to or lower than the softening point of the low-softening-point resin, or is equal to or higher than the softening point of the high-softening-point resin, the property with which the colorant is dispersed in the toner deteriorates, so an image having high chroma cannot be obtained. In addition, color reproducibility such as color mixing property or transparency upon image formation by the fixation of multiple color toners deteriorates in some cases.

The middle-softening-point resin to be used for turning the colorant to be used in the toner of the present invention into the master batch has a main peak in a molecular weight region of 1,000 to 14,000, or preferably in a molecular weight region of 2,000 to 11,000 in a molecular weight distribution measured by gel permeation chromatography (GPC), and preferably has a ratio Mw/Mn of 2.0 or more to 40 or less.

When the main peak is placed in a molecular weight region of less than 1,000, the storage stability of the toner tends to deteriorate. On the other hand, when the main peak is placed in a molecular weight region in excess of 14,000, the low-temperature fixability, gloss, and chroma of the toner tend to reduce. In addition, when the ratio Mw/Mn is less than 2.0, or exceeds 40, the property with which the colorant is dispersed in the toner tends to deteriorate.

In addition, upon production of a master batch from the colorant of the toner of the present invention, a step of melting and kneading the toner to be described later can be used. Further, the master batch in the present invention contains preferably 2 to 25 mass %, more preferably 3 to 20 mass %, or still more preferably 5 to 18 mass % of moisture with respect to the total amount of the colorant. With such water-containing master batch (which may hereinafter be referred to as "water-containing MB"), the colorant can be uniformly and finely dispersed in the toner. The reason for the foregoing is unclear, but possible reasons are as described below.

A first reason is as described below. In a step of melting and kneading a toner raw material mixture containing binder resins and a water-containing MB to provide a second kneaded product (second melting and kneading step), the water-containing MB contains a large amount of water, so the presence of water between colorant particles prevents the aggregation of the colorant particles. Further, moisture that permeates into the aggregate of colorant particles present in some part of the mixture expands by virtue of heat in the second melting and kneading step to collapse the aggregate, whereby the particles are favorably dispersed.

A second reason is as described below. The temperature of the second kneaded product becomes high owing to: the self-heating of the water-containing MB as a result of strong shear applied to the toner raw material mixture at the time of the second melting and kneading step; and heating from the outside on an as-needed basis. However, water deprives heat as heat of evaporation upon evaporation, so the strong adhesion and aggregation of the colorant particles due to heat can be prevented.

A third reason is as described below. Strong shear is applied by an increase in pressure in a kneader due to the expansion of the second kneaded product as a result of the generation of water vapor at the time of the second melting and kneading step, whereby an additionally strong shear force is generated. The force is extremely effective in dispersing all components including colorant particles that are present in the second kneaded product.

A water content of the water-containing MB that can be used in the present invention in excess of 25 mass % is not preferable because the adhesive force of the water-containing MB is so strong owing to the excessively large water content that the MB fuses to a production device such as a Henschel mixer, or a large aggregate is produced in the toner raw material mixture owing to a reduction in fluidity in some cases. A water content of less than 2 mass % is not preferable either because the above-mentioned effect cannot be expected, and the dispersed colorant particles strongly aggregate in a heating and drying step under normal pressure or reduced pressure for removing a trace amount of moisture remaining in the master batch, so it becomes difficult to disperse the colorant favorably again in the subsequent kneading step for toner production.

A known charge control agent can be used in the toner of the present invention to stabilize the chargeability of the toner and to be crosslinked with the binder resins at the time of kneading. A charge control agent is generally incorporated into toner particles in an amount of preferably 0.1 to 10 parts by mass, or more preferably 0.1 to 5 parts by mass with respect to 100 parts by mass of the binder resins, although the amount varies depending on, for example, the kind of the charge control agent and the physical properties of other materials of which the toner particles are constituted. Known examples of such charge control agent include one for controlling toner to be negatively chargeable and one for controlling toner to be positively chargeable. At least one kind of various charge control agents can be used depending on the kind and applications of the toner. In addition, some kinds of charge control agents can not only control the chargeability but also crosslink the binder resins.

Examples of a usable negative charge control agent include: metal compounds of salicylic acid; metal compounds of naphthoic acid; metal compounds of dicarboxylic acid; polymeric compounds each having a sulfonic acid or a carboxylic acid at any one of its side chains; boron compounds; urea compounds; silicon compounds; and calixarene. Examples of a usable positive charge control agent include: quaternary ammonium salts; polymeric compounds having the quaternary ammonium salts at their side chains; guanidine compounds; and imidazole compounds. Each of those charge control agents may be internally or externally added to a toner particle.

In particular, a metal compound of an aromatic carboxylic acid which is colorless and which is capable of: charging the toner of the present invention at a high speed; stably maintaining a constant charge amount; and being crosslinked with the binder resins at the time of kneading is a preferable charge control agent that can be used in the toner. An aluminum compound of an aromatic carboxylic acid is more preferable.

Before the toner of the present invention is used, the fluidity of the toner is preferably adjusted by mixing inorganic fine particles with a mixer such as a Henschel mixer after pulverization and classification, or after surface modification.

Examples of an inorganic powder that can be used in the present invention include: fluorine-based resin powder such as fluorinated vinylidene fine powder and polytetrafluoroethylene fine powder; titanium oxide fine powder; alumina fine powder; silica fine powder such as wet process silica, and dry process silica; silane compound and organic silicon compound of them; and processed silica whose surface is processed by titanium coupling agent or silicon oil. Of those, wet process silica, dry process silica, titanium oxide fine powder and alumina fine powder are specifically preferably used.

Particular examples of the silica obtained through a wet process include silica particles produced from a silica sol suspension, which is obtained by subjecting an alkoxysilane to hydrolysis and a condensation reaction with a catalyst in an organic solvent containing water, by a sol-gel method involving removing the solvent, drying the remainder, and turning the dried product into particles. Silica particles to be produced by the sol-gel method are preferable because the particle size distribution of the particles to be obtained is sharp, because spherical particles can be obtained, and because particles having a desired particle size distribution can be obtained by changing a reaction time.

In addition, the silica obtained through a dry process is a fine powder produced through the vapor phase oxidation of a silicon halide compound, so called dry process silica or fumed silica. The dry process silica or fumed silica is produced by a conventionally known technique. For example, the production utilizes a thermal decomposition oxidation reaction in the oxyhydrogen flame of a silicon tetrachloride gas, and a basic reaction formula for the reaction is represented by the following formula:

$$SiCl_4+2H_2+O_2 \rightarrow SiO_2+4HCl.$$

A composite fine powder of silica and any other metal oxide can also be obtained by using the silicon halide compound with any other metal halide compound such as aluminum chloride or titanium chloride in the production step, and the dry process silica comprehends the composite fine powder as well.

In addition, titanium oxide fine particles obtained by: a sulfuric acid method; a chlorine method; and the low-temperature oxidation (thermal decomposition or hydrolysis) of volatile titanium compounds such as titanium alkoxide, titanium halide, and titanium acetylacetonate are used as the titanium oxide fine powder. Any one of the crystal systems including an anatase type, a rutile type, a mixed crystal of them, and an amorphous type can be used.

In addition, an alumina fine powder obtained by a Bayer method, an improved Bayer method, an ethylene chlorohydrin method, a submerged spark discharge method, an organic aluminum hydrolysis method, an aluminum alum thermal decomposition method, an ammonium aluminum carbonate thermal decomposition method, or a flame decomposition method for aluminum chloride is used as the alumina fine powder. Any one of the crystal systems including α, β, γ, δ, ξ, η, θ, κ, χ, and ρ types, a mixed crystal of them, and an amorphous type is used; an α, δ, γ, or θ type, a mixed crystal of them, or an amorphous type is preferably used.

Hydrophobicity of the inorganic fine powder is imparted by chemically or physically treating the inorganic fine powder with, for example, an organic silicon compound that reacts with, or physically adsorbs to, the inorganic fine powder. A preferable method involves treating the silica fine powder produced through the vapor phase oxidation of a silicon halide compound with an organic silicon compound. Examples of such organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si within a unit located in each of terminals. One of those compounds is used alone or mixture of two or more thereof is used.

The above-mentioned wet process silica or dry process silica treated with a coupling agent having an amino group or with silicone oil may be used as an inorganic fine particle of a fluidizer as required for achieving an object of the present invention. In addition, the fluidizer is desirably added in an amount of 0.01 to 8 parts by mass, or preferably 0.1 to 4 parts by mass with respect to 100 parts by mass of the toner.

Next, a procedure for producing the toner of the present invention will be described.

(Method of Producing Toner)

The toner of the present invention is preferably produced by: melting and kneading binder resins, a colorant, and an arbitrary material; cooling the kneaded product; pulverizing the cooled product; subjecting the pulverized product to a spheroidization treatment or a classification treatment as required; and mixing the resultant with the fluidizer as required.

First, in a raw material mixing step, predetermined amounts of at least a resin and a colorant as toner internal additive are weighed, blended, and mixed. Examples of a mixing device include a Doublecon mixer, a V-type mixer, a drum type mixer, a Super mixer, a Henschel mixer, a Q-type mixer, and a Nauta mixer.

Furthermore, the toner raw materials blended and mixed in the above step are melted and kneaded to melt the binder resins, followed by dispersion of a colorant or the like into the resultant. In the melting and kneading step, a batch-type kneader such as a pressure kneader or a Banbury mixer, or a continuous kneader can be used. Further, a monoaxial or biaxial extruder has gone mainstream because of its superiority such as its ability to perform continuous production. For example, a PCM type biaxial extruder manufactured by Ikegai Corp., a KTK type biaxial extruder manufactured by Kobe Steel, Ltd., a TEM type biaxial extruder manufactured by Toshiba Machine Co., Ltd., a biaxial extruder manufactured by KCK Co., Ltd., or a Co kneader manufactured by Bus Co., Ltd., is generally used. Furthermore, a colored resin composition obtained by melting and kneading the toner raw materials is rolled by a two-roll or the like after the melting and kneading, and is cooled through a cooling step with water or the like.

The raw materials for the toner of the present invention are preferably melted and kneaded at a kneading temperature of 90° C. or higher to 150° C. or lower. The term "kneading temperature" as used herein refers to the temperature of a colored resin composition, which is obtained by melting and kneading the toner raw materials, when the composition is extruded from an extruder. A kneading temperature of lower than 90° C. is not preferable because the raw materials in the toner are apt to be unfavorably dispersed. A kneading temperature in excess of 150° C. is not preferable because, when a low-softening-point resin and a high-softening-point resin are used in combination, compatibility between both the binder resins becomes good, and the two kinds of binder resins in the toner are expected to be dispersed in an ultra-fine manner, so it becomes difficult to obtain the toner physical properties of the present invention.

Next, the cooled product of the colored resin composition obtained in the foregoing is pulverized into particles each having a desired particle diameter in a pulverization step. In the pulverization step, the cooled product is first coarsely pulverized with a crusher, a hammer mill, a feather mill, or the like, and is further finely pulverized with a known air pulverizer or mechanical pulverizer. In the pulverization step, the cooled product is pulverized into particles each having a predetermined toner particle size in a stepwise fashion in this way. Further, the resultant finely pulverized product may be subjected to surface modification, that is, a spheroidization treatment in a surface modification step so that surface-modified particles are obtained. After that, the surface-modified particles are classified with a classifier such as an Elbow jet (manufactured by Nittetsu Mining Co., Ltd.) according to an inertial classification mode, a Turboplex (manufactured by Hosokawa Micron Corporation) according to a centrifugal classification mode, or with a screen classifier such as a Hi-bolter (manufactured by Shin Tokyo Kikai KK) as an air screen as required, whereby toner having a weight average particle diameter of 3 to 11 μm is obtained.

It should be noted that a toner coarse powder produced as a result of classification in a classification step is subjected to the pulverization step again so as to be pulverized. In addition, a fine powder produced in the surface modification step is preferably subjected to a step of blending toner raw materials so as to be recycled in terms of toner productivity.

Further, in the method of producing the toner of the present invention, it is preferable that an inorganic fine particle for imparting fluidity be externally added as an external additive to the toner obtained as described above. A preferable method of externally adding the external additive to the toner involves: blending predetermined amounts of the classified toner and various known external additives with each other; and stirring and mixing the blended product by using a high-speed stirring machine for applying a shear force to a powder such as a Henschel mixer, a Super mixer, or a Q type mixer as an external addition machine. In this case, heat is generated in the external addition machine, and hence an aggregate is apt to be produced, so a temperature around the container portion of the external addition machine is preferably adjusted by a method such as water-cooling.

The toner of the present invention has an average circularity of preferably 0.945 or more to 0.990 or less, or more preferably 0.950 or more to 0.990 or less. The average circularity of the toner is measured with an FPIA 3000 (manufactured by SYSMEX CORPORATION), and a method for the measurement will be described later. When the average circularity of the toner falls within the range, the following advantages can be obtained: good developing ability can be obtained even at the time of high-speed development, and transferability is improved.

Hereinafter, a mechanical pulverizer and a surface modification apparatus to be preferably used for obtaining an average circularity suitable for the toner of the present invention will be described.

Figure 12:
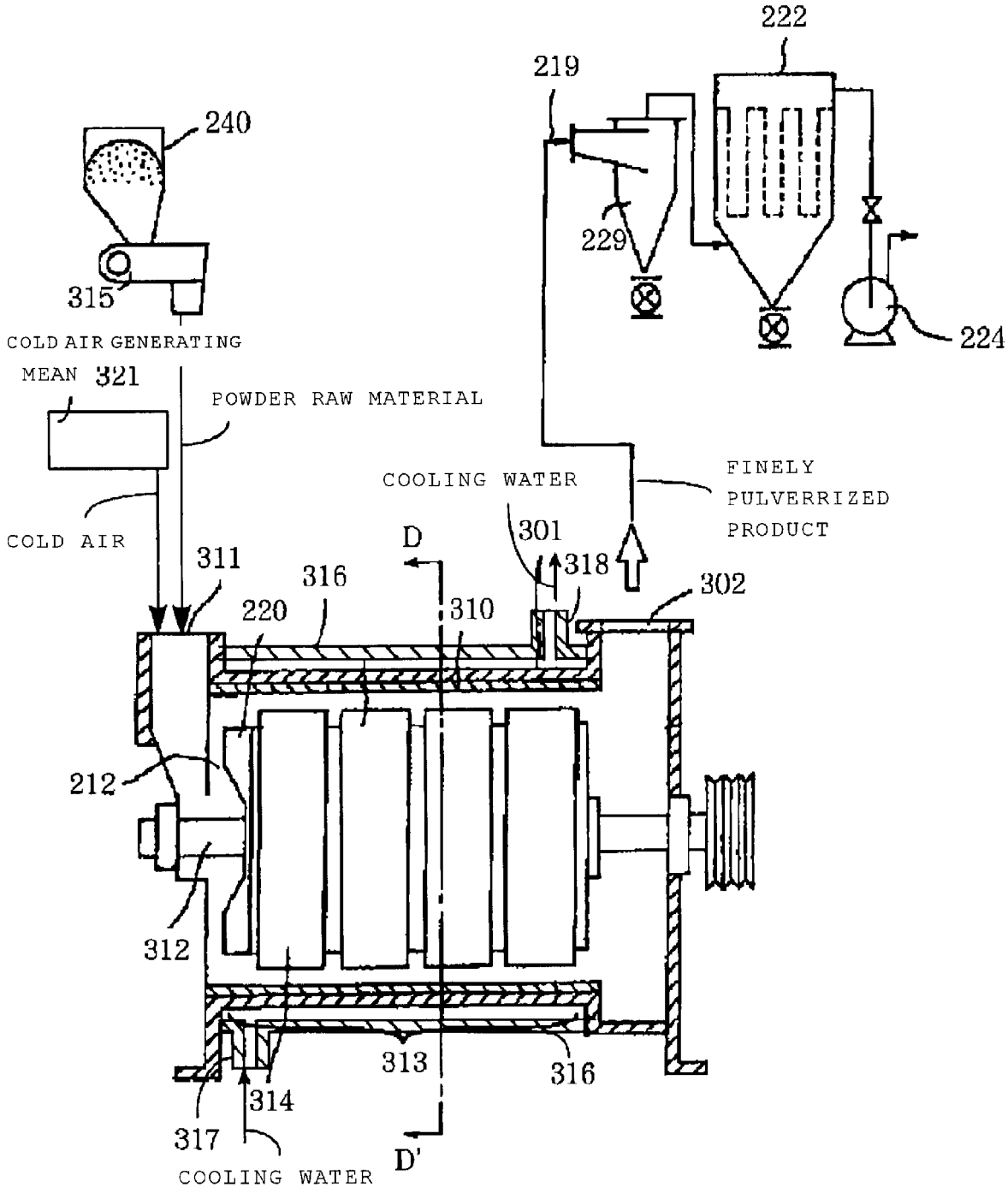
FIG. 12 is a schematic view showing an example of a pulverization apparatus system to be used in the present invention.

A mechanical pulverizer is preferably used as a pulverizing apparatus in the pulverization step upon production of the toner of the present invention. FIG. 12 shows an example of a pulverizing apparatus system for toner particles having a built-in mechanical pulverizer which can be used in the present invention.

A mechanical pulverizer 301 shown in FIG. 12 is constituted of: a casing 313; a jacket 316 in the casing 313 through which cooling water can pass; a rotator 314 composed of a body of rotation placed in the casing 313 and attached to a central rotation axis 312, the rotator rotating at a high speed and having a surface provided with a large number of grooves; a stator 310 placed on the outer periphery of the rotator 314 while retaining a certain interval between itself and the rotator, the stator having a surface provided with a large number of grooves; a raw material input port 311 for introducing a raw material to be treated; and a raw material discharge port 302 for discharging a powder after a treatment. An interval portion between the rotator 314 and the stator 310 is a pulverization zone.

In the mechanical pulverizer constituted as described above, after a predetermined amount of a powder raw material has been inputted from a weight feeder 315 shown in FIG. 12 to the raw material input port 311 of the mechanical pulverizer, particles are introduced into a pulverization treatment chamber, and are instantaneously pulverized by: an impact generated between the rotator 314, which rotates at a high speed in the pulverization treatment chamber and has a surface provided with a large number of grooves, and the stator 310 having a surface provided with a large number of grooves; a large number of very high speed vortex flows occurring behind the impact; and high-frequency pressure vibration generated by the flows. After that, the resultant passes the raw material discharge port 302 to be discharged. The air conveying toner particles passes the raw material discharge port 302, a pipe 219, a collection cyclone 229, a bug filter 222, and a suction blower 224 via the pulverization treatment chamber to be discharged to the outside of the apparatus system. The present invention is preferable because of the following reason: the powder raw material is pulverized as described above, so a desired pulverization treatment can be easily performed without any increase in amount of a fine powder or coarse powder. In addition, such mechanical pulverizer, which is used in the pulverization step, may be used in the surface modification step. It should be noted that, in FIG. 12, reference numeral 212 represents a scroll casing; 220, a distributor; 240, a raw material hopper; 317, a cooling water supply port; 318, a cooling water discharge port; and 319, cold air generating means.

Figure 13:
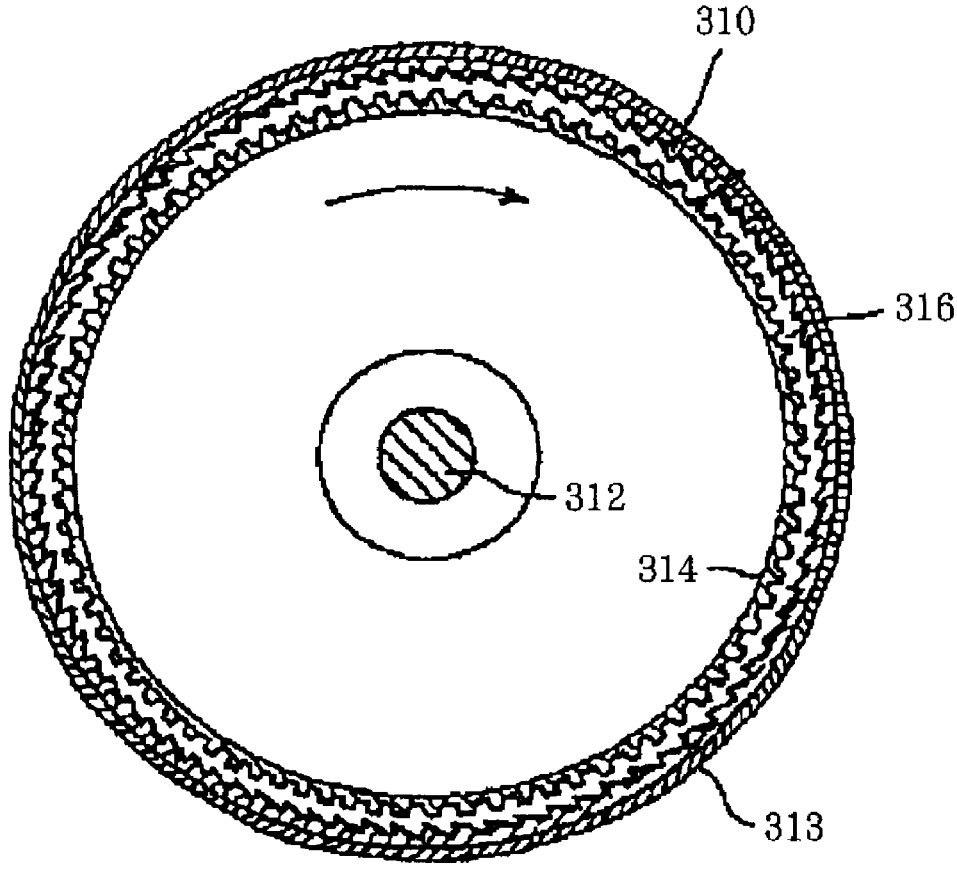
FIG. 13 is an outline sectional view taken along a D-D' surface shown in FIG. 12.

In addition, FIG. 13 shows an outline sectional view taken along a D-D' surface shown in FIG. 12.

Examples of such mechanical pulverizer include: a Kryptron as a pulverizer manufactured by Kawasaki Heavy Industries; a Turbo mill manufactured by Turbo Kogyo Co., Ltd.; an Inomizer manufactured by Hosokawa Micron Corporation; and a Super rotor manufactured by Nisshin Engineering Inc.

Figure 14:
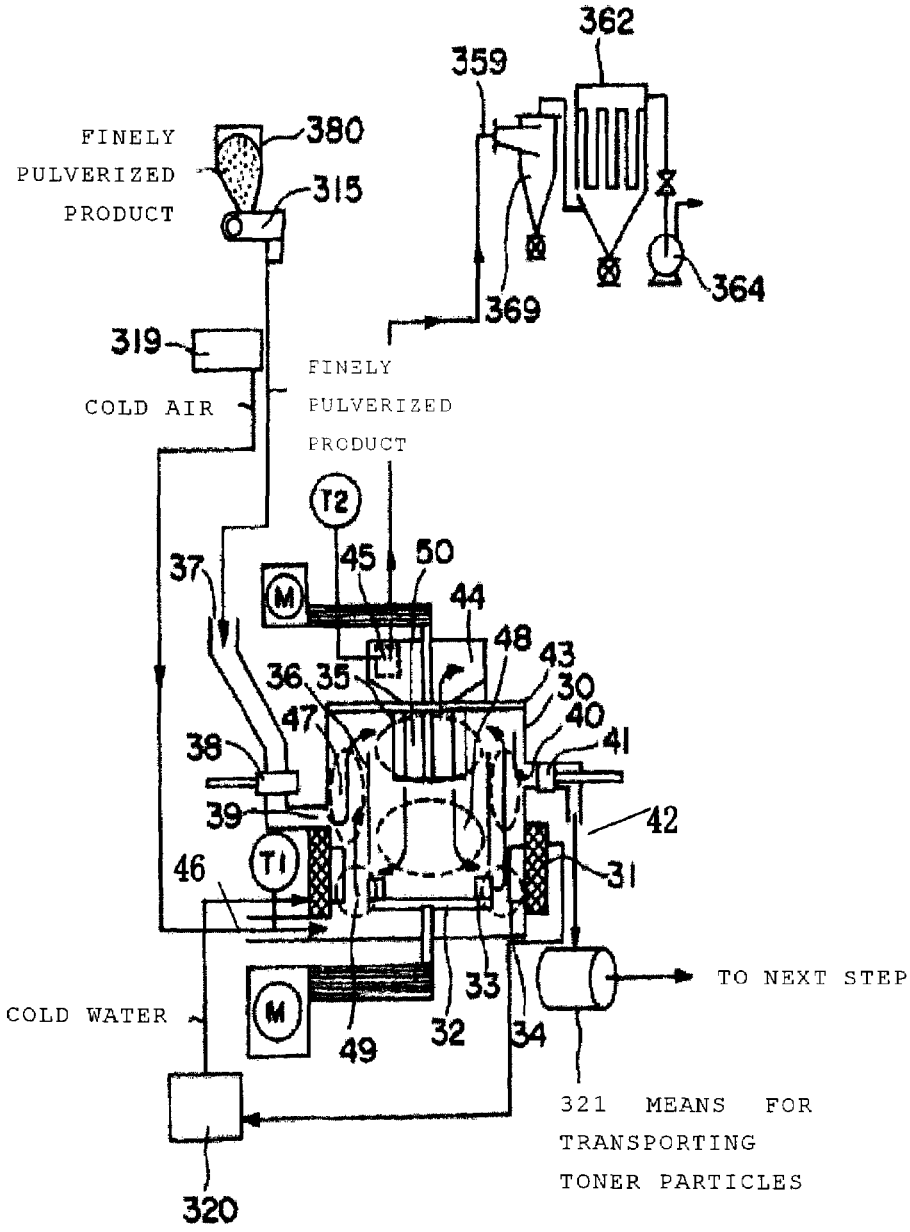
FIG. 14 is a schematic view showing an example of a surface modification apparatus system to be used in the present invention.

In addition, a surface modification apparatus system having a surface modification apparatus shown in FIG. 14 capable of simultaneously performing classification and a surface modification treatment is preferably used in the present invention.

A batch type surface modification apparatus shown in FIG. 14 includes: a cylindrical main body casing 30; a top plate 43 installed on the upper portion of the main body casing so as to be openable/closable; a fine powder discharge portion 44 having a fine powder discharge casing and a fine powder discharge pipe; a cooling jacket 31 through which cooling water or antifreeze can pass; a dispersion rotor 32 as surface modification means, the dispersion rotor 32 being present in the main body casing 30 and attached to the central rotation axis of the casing, the dispersion rotor 32 having multiple square disks 33 on its upper surface, and the dispersion rotor 32 being a disk-like rotator that rotates in a predetermined direction at high speed; a liner 34 fixedly placed on the periphery of the dispersion rotor 32 with a predetermined interval between them, the liner 34 being provided with many grooves on its surface opposed to the dispersion rotor 32; a classification rotor 35 for continuously removing a fine powder and an ultra-fine powder each having a particle diameter equal to or smaller than a predetermined particle diameter in a finely pulverized product; a cold air introduction port 46 for introducing cold air into the main body casing 30; an input pipe formed on the side surface of the main body casing 30 for introducing the finely pulverized product (raw material) and having a raw material input port 37 and a raw material supply port 39; a product discharge pipe having a product discharge port 40 and a product extraction port 42 for discharging toner particles after the surface modification treatment to the outside of the main body casing 30; an openable/closable raw material supply valve 38 installed between the raw material input port 37 and the raw material supply port 39 in order that a surface modification time may be freely adjusted; and a product discharge valve 41 installed between the product discharge port 40 and the product extraction port 42.

The surface of the liner 34 preferably has grooves in order that the surface of a toner particle may be efficiently modified. The number of the square disks 33 is preferably an even number in consideration of a rotation balance. The classification rotor 35 preferably rotates in the same direction as the rotation direction of the dispersion rotor 32 in order that the efficiency of the classification may be improved, and the efficiency with which the surface of a toner particle is modified may be improved. The fine powder discharge pipe has a fine powder discharge port 45 for discharging the fine powder and the ultra-fine powder removed by the classification rotor 35 to the outside of the apparatus.

The surface modification apparatus has, in the main body casing 30, a cylindrical guide ring 36 as guiding means having an axis perpendicular to the top plate 43. The guide ring 36 is provided so that its upper end is distant from the top plate by a predetermined distance. The guide ring 36 is fixed to the main body casing 30 by a support so as to cover at least part of the classification rotor 35. The lower end of the guide ring 36 is provided so as to be distant from each of the square disks 33 of the dispersion rotor 32 by a predetermined distance.

In the surface modification apparatus, a space between the classification rotor 35 and the dispersion rotor 32 is divided by the guide ring 36 into two spaces: a first space 47 outside the guide ring 36 and a second space 48 inside the guide ring 36. The first space 47 is a space for introducing the finely pulverized product and particles subjected to a surface modification treatment into the classification rotor 35. The second space is a space for introducing the finely pulverized product and the particles subjected to a surface modification treatment into the dispersion rotor. A gap portion between each of the multiple square disks 33 installed on the dispersion rotor 32 and the liner 34 constitutes a surface modification zone 49. The classification rotor 35 and the peripheral portion of the classification rotor 35 constitute a classification zone 50.

The finely pulverized product introduced into a raw material hopper 380 passes from the raw material input port 37 of the input pipe to the raw material supply valve 38 via the weight feeder 315 to be supplied from the raw material supply port 39 to the inside of the apparatus. In the surface modification apparatus, cold air generated in cold air generating means 319 is supplied from the cold air introduction port 46 to the inside of the main body casing, and, furthermore, cold water from cold water generating means 320 is supplied to the cooling jacket 31 so that the temperature in the main body casing is adjusted to a predetermined temperature. The supplied finely pulverized product reaches the classification zone 50 near the classification rotor 35 while whirling in the first space 47 outside the cylindrical guide ring 36 owing to: an air quantity to be sucked by a blower 364; and a swirl flow formed by the rotation of the dispersion rotor 32 and the rotation of the classification rotor 35 so as to be subjected to a classification treatment. The orientation of the swirl flow formed in the main body casing 30 is the same as the rotation direction of each of the dispersion rotor 32 and the classification rotor 35.

The fine powder and the ultra-fine powder to be removed by the classification rotor 35 are sucked from a slit of the classification rotor 35 by the suction force of the blower 364, and are collected by a cyclone 369 and a bug 362 via the fine powder discharge port 45 of the fine powder discharge pipe and a cyclone inlet 359. The finely pulverized product from which the fine powder and the ultra-fine powder have been removed reaches the surface modification zone 49 near the dispersion rotor 32 via the second space 48 so that particles are subjected to a surface modification treatment with the square disks 33 (hammers) provided for the dispersion rotor 32 and the liner 34 provided for the main body casing 30. The surface-modified particles reach the vicinity of the classification rotor 35 again while whirling along the guide ring 36, and a fine powder and an ultra-fine powder are removed from the surface-modified particles by classification with the classification rotor 35. After a treatment for a predetermined time period, the discharge valve 41 is opened, and surface-modified toner particles from which a fine powder and an ultra-fine powder each having a particle diameter equal to or smaller than a predetermined particle diameter have been removed are taken out of the surface modification apparatus.

The toner particles having a weight average particle diameter and a particle size distribution adjusted to a predetermined weight average particle diameter and a predetermined particle size distribution, and each subjected to surface modification to have a predetermined circularity are transferred to a step of externally adding an external additive by means 321 for transporting toner particles.

The surface modification apparatus that can be used in the present invention has the dispersion rotor 32, the supply port 39 for a finely pulverized product (raw material), the classification rotor 35, and the fine powder discharge port from the lower side of its vertical direction. Therefore, in ordinary cases, a portion for driving of the classification rotor 35 (such as a motor) is provided additionally above the classification rotor 35, and a portion for driving of the dispersion rotor 32 is provided additionally below the dispersion rotor 32. It is difficult for the surface modification apparatus to be used in the present invention to supply a finely pulverized product (raw material) from vertically above the classification rotor 35 unlike, for example, a TSP separator (manufactured by Hosokawa Micron Corporation) having only the classification rotor 35 described in JP 2001-259451 A.

In the present invention, a site having the largest diameter of the classification rotor 35 preferably has a tip circumferential speed of 30 to 120 m/sec. The classification rotor has a tip circumferential speed of more preferably 50 to 115 m/sec, or still more preferably 70 to 110 m/sec. A tip circumferential speed of less than 30 m/sec is not preferable because a classification yield is apt to reduce, and the amount of an ultrafine powder in toner particles tends to increase. A tip circumferential speed in excess of 120 m/sec is apt to cause the following problem: an increase in vibration of the apparatus.

Further, a site having the largest diameter of the dispersion rotor 32 preferably has a tip circumferential speed of 20 to 150 m/sec. The dispersion rotor 32 has a tip circumferential speed of more preferably 40 to 140 m/sec, or still more preferably 50 to 130 m/sec. A tip circumferential speed of less than 20 m/sec is not preferable because it becomes difficult to obtain surface-modified particles each having a sufficient circularity. A tip circumferential speed in excess of 150 m/sec is not preferable because particles are apt to adhere in the apparatus owing to an increase in temperature in the apparatus, and a reduction in yield in which toner particles are classified is apt to occur. When the tip circumferential speed of each of the classification rotor 35 and the dispersion rotor 32 is set to fall within the above range, the yield in which the toner particles are classified can be improved, and the surface of each particle can be efficiently modified. It should be noted that, in FIG. 14, reference symbol T1 represents a temperature gauge for measuring the temperature of cold air; T2, a temperature gauge for measuring a temperature behind the classification rotor; and M, a motor.

Next, an image forming method to which the toner of the present invention can adapt will be described in detail.

(Image Forming Method)

Figure 8:
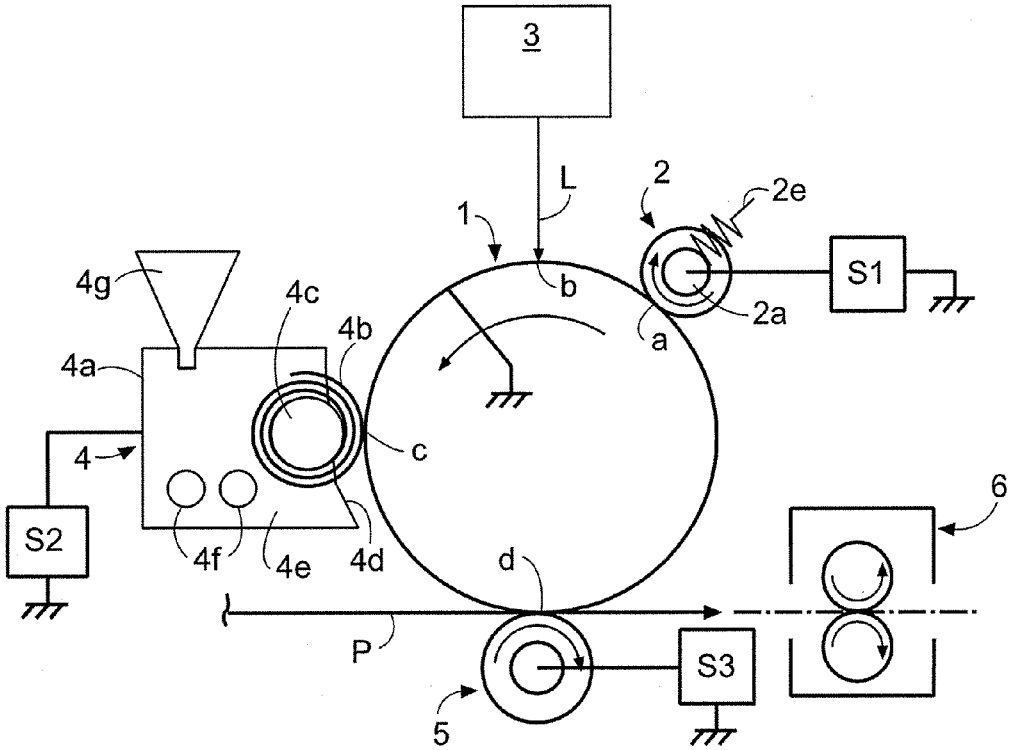
FIG. 8 is a schematic view showing an example of an image forming apparatus using the toner of the present invention.
Figure 9:
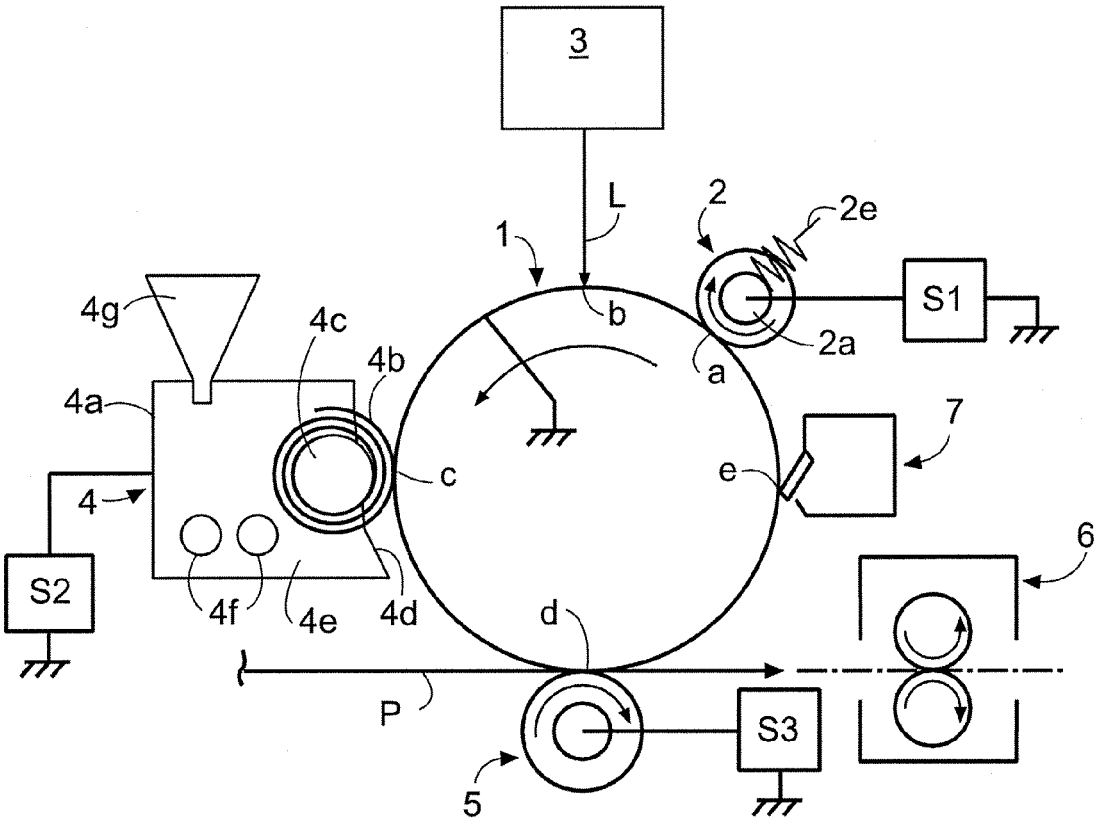
FIG. 9 is a schematic view showing an example of the image forming apparatus using the toner of the present invention.
Figure 10:
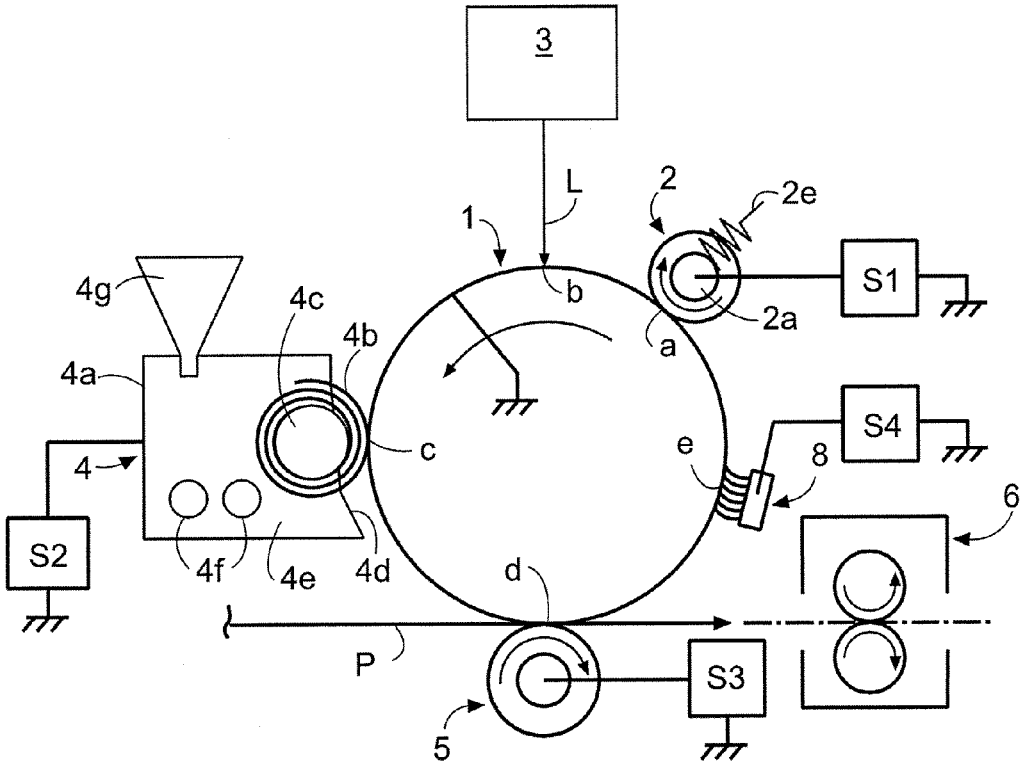
FIG. 10 is a schematic view showing an example of the image forming apparatus using the toner of the present invention.

FIGS. 8 to 10 each show an example of an image forming apparatus employing an image forming method of the present invention. In FIG. 8, an electrophotographic photosensitive member 1 (which may hereinafter be referred to as "photosensitive member") as an electrostatic latent image-bearing member rotates in the direction indicated by an arrow in the figure. The photosensitive member 1 is charged by a charging device 2 as charging means. Laser light L is incident from an exposing device 3 as electrostatic latent image forming means on the charged surface of the photosensitive member 1, whereby an electrostatic latent image is formed. After that, the electrostatic latent image is visualized as a toner image by a developing device 4 as developing means, and is transferred onto a transfer material P by a transferring device 5 as transferring means. The transfer material P is subjected to fixation under heat by a fixing device 6 as fixing means to be outputted as an image. Transfer residual toner remaining on the surface of the photosensitive member without being transferred by the transferring means may be recovered by a cleaning device 7 as cleaning means as shown in FIG. 9. Alternatively, the following procedure is permitted: electrostatic polarity is provided for the transfer residual toner while a bias is applied by an auxiliary brush charging device 8 as smoothing means as shown in FIG. 10, and the toner is used again in development or recovered by the developing device through the charging means and the electrostatic latent image forming means described above. It should be noted that, in FIGS. 8 to 10, reference symbol 2*a* represents a conductive support; 2*e*, a pressing spring; 4*a*, a developer container; 4*b*, a developer carrier; 4*c*, a magnet roller; 4*d*, a developer regulating member; 4*e*, a developer; 4*f*, a developer stirring member; 4*g*, a developer hopper; a, a charging portion; b, an exposing portion; c, a developing portion; d, a transferring portion; and S1, S2, S3, and S4, power supplies.

Here, each step of the image forming method that can be employed in the present invention will be described in more detail.

(Charging Step)

A charging step is not particularly limited as long as means for charging an electrophotographic photosensitive member by applying charge to the surface of the photosensitive member is used. A device for charging an electrophotographic photosensitive member while being out of contact with the electrophotographic photosensitive member like corona charging means, or a device for charging an electrophotographic photosensitive member by bringing a conductive roller or blade into contact with the electrophotographic photosensitive member can be used as the charging means.

(Electrostatic Latent Image Forming Step)

A known exposing device can be used as exposing means in an electrostatic latent image forming step. For example, semiconductor laser or a light-emitting diode is used as a light source, and a scanning optical unit composed of a polygon mirror, a lens, and a mirror can be used.

Regions where electrostatic latent images can be formed are classified into a region in a main scanning direction and a region in a sub-scanning direction. The region in the main scanning direction on a photosensitive member is a region ranging from the position at which irradiation with a laser beam can be initiated to the position at which the irradiation with the laser beam is completed in the direction parallel to the rotation axis of the photosensitive member. In addition, the region in the sub-scanning direction on the surface of the photosensitive member is a region ranging from the position at which the first main scanning line can be irradiated with a laser beam to the position at which the final main scanning line can be irradiated with the laser beam in image data corresponding to one page. In this region, a rotating polygon mirror is irradiated with laser beams from semiconductor laser as a light source. Then, the laser beams that are periodically deflected to be reflected are converged with a scanning lens, and the upper portion of the photosensitive member rotating in the sub-scanning direction is repeatedly scanned with the converged beam in the main scanning direction perpendicular to the sub-scanning direction, whereby the exposure of an electrostatic latent image on the photosensitive member is performed.

The electrostatic latent image formed on the photosensitive member in the electrostatic latent image forming step as described above is to be visualized as a toner image with a developer in a developing step.

(Developing Step)

Methods that can be employed in the developing step are mainly classified into a one-component, contact developing method eliminating the need for a carrier and a two-component developing method involving the use of toner and a carrier. In the present invention, description will be given by taking the two-component developing method as an example from the viewpoint of high image quality as a need from a borderless copy.

The two-component developing method is a method involving: forming a magnetic brush of a two-component developer having non-magnetic toner and a magnetic carrier on a developer carrier (developing sleeve) having a magnet in itself; coating the carrier with a layer of the magnetic brush having a predetermined thickness with a developer layer thickness regulating member; conveying the resultant to a developing region opposed to a photosensitive member; and visualizing the above electrostatic latent image as a toner image by bringing the magnetic brush close to, or into contact with, the surface of the photosensitive member while applying a predetermined developing bias between the photosensitive member and the developing sleeve in the developing region.

Examples of a magnetic carrier that can be used in such two-component developer include an iron powder carrier, a ferrite carrier, and a magnetic fine particle-dispersed resin carrier obtained by dispersing magnetic fine particles in a binder resin. Because the specific resistance of the iron powder carrier itself is low, the charge of an electrostatic latent image leaks through the carrier so that the electrostatic latent image is disturbed. As a result, an image defect occurs in some cases. In addition, the ferrite carrier itself has a relatively high specific resistance, but a magnetic brush is apt to be rigid owing to the large saturation magnetization of the carrier, so the brush mark unevenness of the magnetic brush occurs on a toner image in some cases. Accordingly, a magnetic carrier having a true specific gravity of 2.5 g/cm$^3$ or more to 5.2 g/cm$^3$ or less is preferable. For example, a magnetic fine particle-dispersed resin carrier obtained by dispersing magnetic fine particles in a binder resin is suitably used. The magnetic fine particle-dispersed resin carrier has a high specific resistance as compared to that of the ferrite carrier, and has a small saturation magnetization and a small true specific gravity, so the magnetic fine particle-dispersed resin carrier prevents the leakage of the charge of an electrostatic latent image, and does not make a magnetic brush rigid. Therefore, the magnetic fine particle-dispersed resin carrier is preferable because a good toner image having neither image defect nor brush mark unevenness can be formed.

In addition, the magnetic fine particle-dispersed resin carrier may have a resin coating layer on its surface. Materials of which the resin coating layer is constituted have only to include at least a binder resin; the layer may contain an additive such as a conductive fine particle as a resistance regulator, a fine particle for forming irregularities, or a charge control agent having property with which charge is applied to toner. Further, a treatment with, for example, a coupling agent may be performed in order that adhesiveness between the surface of the carrier and the resin coating layer may be improved.

(Transferring Step)

Methods that can be employed in a transferring step are a method involving transferring a toner image on the surface of a photosensitive member onto a transfer material while a transferring member is out of contact with the photosensitive member like corona transferring means and a method involving bringing a transferring member such as a roller or an endless belt into contact with a photosensitive member to transfer a toner image on the surface of the photosensitive member onto a transfer material.

(Cleaning Step)

In addition, the image forming method of the present invention may further include a cleaning step of cleaning transfer residual toner on a photosensitive member with the cleaning device 7 as shown in FIG. 9 at a time point after the transfer and before the charging step. Examples of methods that can be employed in the cleaning step include known methods such as blade cleaning, fur brush cleaning, and roller cleaning.

(Smoothing Step)

In addition, the image forming method of the present invention may further include a smoothing step involving the use of smoothing means 8 having bias applying means as shown in FIG. 10 for the purpose of uniformizing the charged polarity of transfer residual toner on a photosensitive member in order that the transfer residual toner may be smoothed at a time point after the transfer and before the charging step, and the recovery rate of the transfer residual toner at the time of development may be increased.

In the smoothing step, negatively chargeable toner is preferable because the application of a bias for negatively charging transfer residual toner can alleviate the adhesion of the transfer residual toner to a charging member in the charging step. In this case, the recovery rate of the transfer residual toner at the time of development is increased. In addition, a brush-like smoothing member is preferably used. Further, multiple smoothing members of such type as described above are preferably provided because the adhesion of the transfer residual toner to the charging member can be alleviated, and the recovery rate of the transfer residual toner at the time of development is increased.

(Fixing step)

Figure 2:
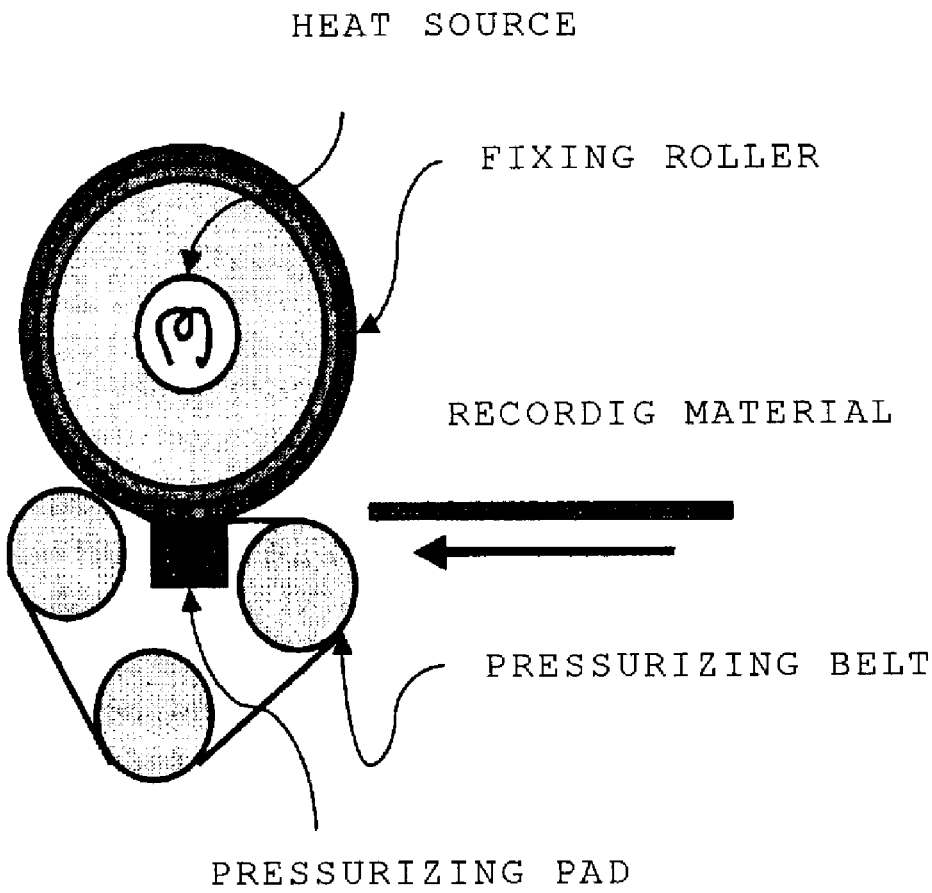
FIG. 2 is a schematic view showing an example of a fixing unit subjected to the evaluation of the toner of the present invention for fixing ability.

Any one of the fixing devices such as a conventional hard roller-based fixing device composed of a pair of rollers and such belt fixing device as shown in FIG. 2 using a light-pressure fixing system corresponding to recent demands for an increase in speed, and a reduction in energy consumption, of an image forming apparatus can be used in a fixing step. In the present invention, description will be given by taking belt fixation as an example from the viewpoints of an increase in speed, and a reduction in energy consumption, of an image forming apparatus, and the availability of a wide variety of recording materials.

Because the light-pressure fixing system such as belt fixation has a small heat capacity, the system can shorten a time period required for the temperature of the system to reach a fixation set temperature (adjustment temperature), and is excellent in quick start property. In addition, the system has the following advantage: a fixing unit itself can be reduced in size and weight because the system does not use a thick metal part or multiple heaters unlike a conventional hard roller system.

In addition, in the belt fixation, at least one member of which a nip is formed is an endless belt, so a wide fixing nip width (wide nip) can be easily formed. As a result, a time period for which a recording material is heated can be lengthened, and hence the belt fixation is advantageous for high-speed fixation. In addition, the belt fixation is advantageous in terms of high gloss and high chroma. In contrast, in a conventional hard roller system, the formation of a wide nip requires an increase in thickness of an elastic layer, so a heat capacity increases. Accordingly, the system is disadvantageous in terms of energy savings. Therefore, the belt fixation with which a wide nip can be easily formed without any increase in thickness of an elastic layer is preferably used as a fixing system having a small heat capacity and capable of achieving compatibility between an increase in speed and energy savings in the present invention.

On the other hand, in the above-mentioned belt fixation, a wide nip can be formed, but a reduction in fixation temperature is apt to occur owing to continuous copying, and a fixation temperature distribution at a nip portion is apt to be nonuniform. In addition, a fixing pressure distribution at the nip portion is also apt to be nonuniform. An increase in applied pressure in the belt fixation causes the belt to slip on a body of rotation for driving the belt, or causes the belt to move over to the left or right side of rollers between which the belt suspends, so an applied pressure must be reduced. As described above, the "applied pressure" in the belt tends to be light as compared to that in the case of a hard roller system.

However, the use of the toner of the present invention can solve the above-mentioned concerns of such light-pressure fixing system capable of satisfying recent demands for an increase in speed and energy savings in an excellent manner.

(Full-color Image Forming Apparatus)

Figure 11:
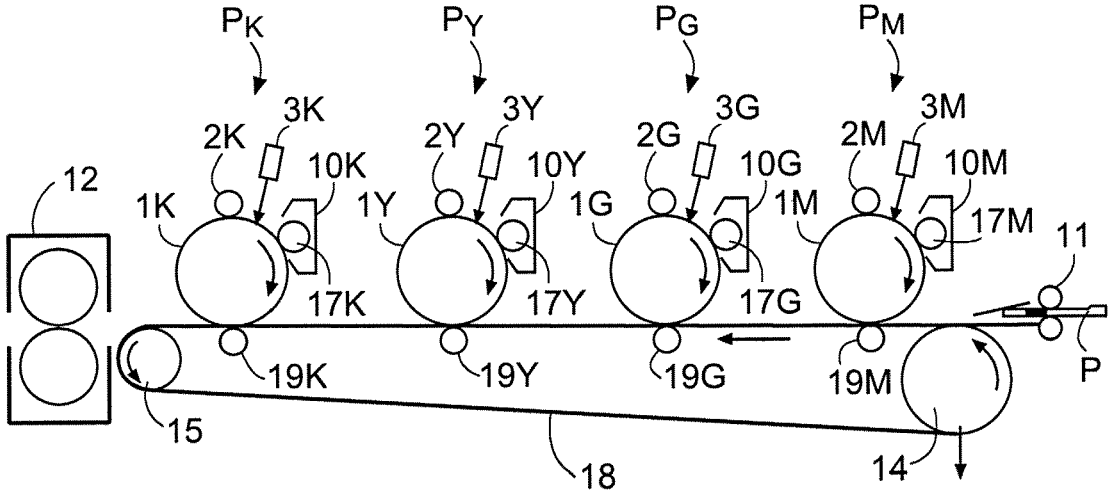
FIG. 11 is a schematic view showing an example of a full-color image forming apparatus employing an image forming method of the present invention.

In addition, FIG. 11 shows an example of a full-color image forming apparatus employing the image forming method of the present invention. The image forming apparatus shown in FIG. 11 is a four-station laser beam printer having four image forming stations. The respective image forming stations are provided in correspondence with four colors: a magenta (M) color, a cyan (C) color, a yellow (Y) color, and a black (K) color. The respective image forming stations ($P_K$, $P_Y$, $P_C$, and $P_M$) are means for developing and transferring images having the respective colors. The order in which the image forming station $P_K$ for a black toner, the image forming station $P_Y$ for a yellow toner, the image forming station $P_C$ for a cyan toner, and the image forming station $P_M$ for a magenta toner are arranged is not limited to that shown in the figure, and the rotation direction of each of an electrophotographic photosensitive member and a roller is not limited to that indicated by an arrow in the figure. In FIG. 11, electrophotographic photosensitive members 1K, 1Y, 1C, and 1M as electrostatic latent image-bearing members each rotate in the direction indicated by the arrow in the figure. Each of the photosensitive members is charged by the corresponding one of charging devices 2K, 2Y, 2C, and 2M as charging means. Laser light L is incident on the charged surface of each of the photosensitive members from the corresponding one of exposing devices 3K, 3Y, 3C, and 3M as electrostatic latent image forming means, whereby electrostatic latent images are formed. After that, the electrostatic latent images are visualized as toner images by developing devices 10K, 10Y, 10C, and 10M as developing means, and are transferred onto a transfer material P by transferring devices 19K, 19Y, 19C, and 19M as transferring means, and the transfer material P is subjected to fixation under heat by a fixing device 12 as fixing means to be outputted as an image. Here, reference symbols 17K, 17Y, 17C, and 17M each represent a developer carrier, and a conveying belt 13 is placed so as to suspend between a driving roller 14 and a driven roller 15. The conveying belt 13 is rotationally driven in the direction indicated by an arrow a by the rotation of the driving roller 14 in the direction indicated by an arrow b, and bears the transfer material P fed through a sheet feeding portion 11 to convey the transfer material to the image forming stations $P_M$, $P_C$, $P_Y$, and $P_K$ sequentially.

Hereinafter, measurement methods concerning the present invention will be described in detail.

(Measurement of THF Insoluble Matter of Binder Resin in Toner by Soxhlet Extraction of Toner)

1.0 g of toner is weighed (W1 (g)). The weighed toner is placed in extraction thimble (such as No. 86R (size 28×100 mm), manufactured by ADVANTEC), and is set in a Soxhlet extractor so that the toner is extracted by using 200 ml of tetrahydrofuran (THF) as a solvent for 2, 4, 8, and 16 hours. In this case, the extraction is performed at such a reflux rate that the extraction cycle of the solvent is once per about 4 to 5 minutes. After the completion of the extraction, the extraction thimble is taken out and dried in a vacuum at 40° C. for 8 hours, and the extract residue is weighed (W2 (g)).

Next, the weight of incineration ash in the toner is determined (W3 (g)). The weight of the incineration ash is determined through the following procedure. About 2 g of a sample are placed in a 30-ml magnetic crucible that has been precisely weighed in advance and are precisely weighed so that the mass (Wa (g)) of the sample is precisely weighed. The crucible is placed in an electric furnace, heated at about 900° C. for about 3 hours, left standing to cool in the electric furnace, and left standing to cool at normal temperature in a desiccator for 1 hour or longer before the mass of the crucible is precisely weighed. The weight (Wb (g)) of the incineration ash is determined from the following equation:

$$(Wb/Wa)\times 100=\text{Incineration ash content(mass \%)}.$$

The mass (W3 (g)) of the incineration ash of the sample can be determined from the incineration ash content.

$$W3=W1\times[\text{incineration ash content(mass \%)}](g)$$

A THF insoluble matter can be determined from the following equation:

$$\text{THF insoluble matter}=\{(W2-W3)/(W1-W3)\}\times 100(\%).$$

It should be noted that the THF insoluble matter of a sample containing no component other than a resin such as a binder resin is determined by using a predetermined amount (W1 (g)) of the resin that has been weighed and the weight (W2 (g)) of an extract residue, which is determined through the same step as that described above, from the following equation:

$$\text{THF insoluble matter}=(W2/W1)\times 100(\text{mass \%}).$$

(Measurement of Molecular Weight Distribution of Binder Resin)

The molecular weight of a chromatogram by gel permeation chromatography (GPC) is measured under the following conditions. In the present application, an HLC-8120GPC (manufactured by TOSOH CORPORATION) was used in the measurement. A column is stabilized in a heat chamber at 40° C. Tetrahydrofuran (THF) as a solvent is allowed to flow into the column at the temperature at a flow rate of 1 ml/min, and about 50 to 200 μl of a THF sample solution of a binder resin having a sample concentration adjusted to 0.05 to 0.6 mass % are injected for measurement. In measuring the molecular weight of the sample, the molecular weight distribution possessed by the sample is calculated from a relationship between a logarithmic value of an analytical curve prepared by several kinds of monodisperse polystyrene standard samples and the number of counts (retention time). Examples of standard polystyrene samples for preparing an analytical curve that can be used include samples manufactured by TOSOH CORPORATION or by Pressure Chemical Co. each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ or $4.48\times10^6$. At least about ten standard polystyrene samples are suitably used. A refractive index (RI) detector is used as a detector. It is recommended that a combination of multiple commercially available polystyrene gel columns be used as the column for accurately measuring a molecular weight region of $10^3$ to $2\times10^6$. Examples of the combination include: a combination of shodex GPC KF-801, 802, 803, 804, 805, 806, and 807 manufactured by Showa Denko K.K.; and a combination of μ-styragel 500, $10^3$, $10^4$, and $10^5$ manufactured by Waters Corporation.

(Measurement of the Temperature at which a Binder Resin Starts to Flow Out (Tfb) and Softening Point (1/2 Method Temperature (T1/2)) of the Binder Resin with Flow Tester)

Measurement is performed with an elevated type flow tester on the basis of JIS K 7210. A specific measurement method is shown below.

While a sample obtained by pelletizing about 1.1 g of a resin with a pressure molder is heated by using an elevated type flow tester (manufactured by Shimadzu Corporation) at a rate of temperature increase of 6° C./min, a load of 20 kgf (196 N) is applied to the sample by using a plunger so that a nozzle having a diameter of 1 mm and a length of 1 mm is extruded. A plunger fall out amount (flow value)-temperature curve is drawn on the basis of the result of the extrusion. The temperature at which the sample starts to flow out is represented by Tfb (° C.). The height (total outflow) of the S-shaped curve is represented by h, and the temperature corresponding to h/2 [0142] (the temperature at which one half of the resin flows out) is defined as the 1/2 method temperature (T1/2) (° C.) of the resin. In the present invention, the 1/2 method temperature was defined as the softening point (Tm) (° C.) of the resin.

(Measurement of Glass Transition Temperature (Tg) (° C.) of Binder Resin and Highest Endothermic Peak of Toner)

The glass transition temperature (Tg) of a binder resin and the highest endothermic peak of the toner can be measured by using a differential scanning calorimeter (DSC measuring device) or a DSC 2920 (manufactured by TA Instruments Japan Inc.) in conformity with ASTM D3418-82. Temperature curve: Temperature Increase I (20° C. to 200° C., rate of temperature increase 10° C./min)

Temperature Decrease I (200° C. to 20° C., rate of temperature decrease 10° C./min)

Temperature Increase II (20° C. to 200° C., rate of temperature increase 10° C./min)

A measurement method is as described below. 5 to 20 mg, preferably 10 mg, of a measurement sample are precisely weighed. The sample is loaded into an aluminum pan. An empty aluminum pan is used as a reference. Measurement is performed in the measurement temperature range of 30 to 200° C. at a rate of temperature increase of 10° C./min at normal temperature and normal humidity. The temperature corresponding to the middle point of a displacement region from a base line in the course of Temperature Increase II is defined as the Tg of a binder resin. In addition, the highest endothermic peak of the toner is a peak having the highest height from the base line in a region equal to or higher than the endothermic peak of the binder resin (Tg) in the course of Temperature Increase II. When the endothermic peak of the binder resin (Tg) overlaps with another endothermic peak so that it is difficult to judge a highest endothermic peak, a peak having the highest height out of the local maximum peaks in the overlapping peak is defined as the highest endothermic peak of the toner of the present invention.

(Measurement of Storage Elastic Modulus of Toner)

The storage elastic modulus G' (140° C.) of the toner in the present invention is determined by the following method.

An ARES (manufactured by Rheometric Scientific F.E. Ltd.) was used as a measuring device. Storage elastic moduli G' were measured under the following conditions in the temperature range of 60 to 200° C.

Measurement jig: A circular parallel plate having a diameter of 8 mm is used. A shallow cup corresponding to the circular parallel plate is used on an actuator side. A gap between the bottom surface of the shallow cup and the circular plate is about 2 mm.

Measurement sample: Toner is molded under pressure into a disk-like sample having a diameter of about 8 mm and a height of about 2 mm before use.

Measurement frequency: 6.28 rad/sec

Setting of measurement distortion: An initial value is set to 0.1%, and then measurement is performed according to an automatic measurement mode.

Correction to elongation of sample: Adjustment is performed according to an automatic measurement mode.

Measurement temperature: A temperature is increased from 60 to 200° C. at a rate of 2° C./min.

A value for the storage elastic modulus G' at 140° C. upon measurement of the storage elastic moduli G' in the temperature range of 60 to 200° C. by the above method was defined as the G' (140° C.).

(Measurement of Particle Size Distribution of Toner)

A Coulter Counter TA-II or Coulter Multisizer II (manufactured by Beckman Coulter, Inc) is used as a measuring device. An aqueous solution of NaCl having a concentration of about 1% is used as an electrolyte solution. An electrolyte solution prepared by using primary grade sodium chloride or, for example, an ISOTON (registered trademark)-II (manufactured by Coulter Scientific Japan, Co.) can be used as the electrolyte solution.

A measurement method is as described below. 100 to 150 ml of the electrolyte aqueous solution are added with 0.1 to 5 ml of a surfactant (preferably an alkylbenzenesulfonate) as a dispersant. Further, 2 to 20 mg of a measurement sample are added to the mixture. The electrolyte solution in which the sample has been suspended is subjected to a dispersion treatment with an ultrasonic dispersing unit for about 1 to 3 minutes. The volumes and number of sample particles are measured for each channel by using the measuring device with the aide of a 100-μm aperture as an aperture, and the volume distribution and number distribution of the sample are calculated. The weight average particle diameter (D4) of the sample is determined from those resultant distributions. The channels to be used consist of 13 channels: a channel having a particle diameter range of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32 to 40.30 μm.

(Measurement of Average Circularity of Toner)

The average circularity of the toner is measured with a flow-type particle image analyzer "FPIA-3000 type" (manufactured by SYSMEX CORPORATION) under measurement and analysis conditions at the time of a calibration operation.

The measurement principle of the flow-type particle image analyzer "FPIA-3000 type" is as follows: a flowing particle is photographed as a static image, and the image is analyzed. A sample added to a sample chamber is fed to a flat sheath flow cell with a sample sucking syringe. The sample fed to the flat sheath flow cell is sandwiched between sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at an image processing resolution of 512×512 (0.37×0.37 μm per pixel) so that the border of each particle image is sampled. Then, the projected area, perimeter, and the like of each particle image are measured.

Next, the projected area S and perimeter L of each particle image are determined. A circle-equivalent diameter and a circularity are determined by using the area S and the perimeter L described above. The term "circle-equivalent diameter" refers to the diameter of a circle having the same area as that of the projected area of a particle image. The "circularity" is defined as a value obtained by dividing the perimeter of a circle determined from the circle-equivalent diameter by the perimeter of a particle projected image, and is calculated from the following equation:

$$C=2\times\sqrt{(n\times S)}/L.$$

When a particle image is of a circular shape, the circularity of the particle in the image becomes 1. As the degree of irregularities in the outer periphery of the particle image increases, the circularity shows a reduced value.

After the circularities of the respective particles have been calculated, circularities in the range of 0.200 to 1.000 are divided into 800 sections, and the average circularity of the particles is calculated by using the number of measured particles.

In addition, the following table shows the measurement and analysis conditions of the flow-type particle image analyzer "FPIA-3000 type" at the time of a calibration operation.

TABLE 1

| | | |
|---|---|---|
| Measurement conditions | Measurement mode | HPF |
| | Quantitative count/total count | Quantitative count |
| | Number of total counts | 3000 |
| | Number of repetitions of measurement | Once |
| Sheath liquid condition | Sheath liquid | Particle sheath |
| Device state | Ultrasonic wave intensity | 5% |
| | Irradiation with ultrasonic wave during measurement | Absent |
| | Irradiation time before measurement | 0 second |
| | Stirring mode | Present |
| | Target value for number of revolutions in stirring | 300 rpm |
| | Monitoring range for number of revolutions | 100 rpm |
| Conditions for particle analysis | BG compensation | Present |
| | Smoothing filter | Median |
| | Edge enhancing filter | 2D filter |
| | Binarization threshold set coefficient [A %] | 85% |
| | Binarization threshold set coefficient [B] | 0 |
| | Particle diameter correction | Present |
| Conditions for statistical analysis | Dilution factor | 1 |
| | Smoothing | Absent |
| | Frame correction | Present |
| | Concentration correction | Present |
| Settings for image processing substrate | Effective minimum number of pixels | 5 |
| | Median filter | 1 |
| | Laplacian filter | 1 |
| | Binarization threshold set coefficient [A %] | 90% |
| | Binarization threshold set coefficient [B] | 0 |

A specific measurement method in the present invention is as described below. After 20 ml of ion-exchanged water had been added with 0.1 to 5 ml of a surfactant, preferably sodium dodecylbenzenesulfonate, as a dispersant, 20 mg of a measurement sample were added to the mixture, and the whole was subjected to a dispersion treatment with a desktop ultrasonic cleaning and dispersing machine having an oscillatory frequency of 50 kHz and an electrical output of 150 W (such as "VS-150" (manufactured by VELVO-CLEAR)) for 2 minutes, whereby a dispersion liquid for measurement was obtained. In this case, the dispersion liquid is appropriately cooled so as to have a temperature of 10° C. or higher to 40° C. or lower.

The flow-type particle image analyzer mounted with a standard objective lens (at a magnification of 10) was used for measurement, and a particle sheath "PSE-900A" (manufactured by SYSMEX CORPORATION) was used as a sheath liquid. The dispersion liquid prepared in accordance with the above procedure was introduced into the flow-type particle image analyzer, and 3,000 toner particles were measured according to an HPF measurement mode and a total count mode. The average circularity of the toner was determined with a binarization threshold at the time of particle analysis set to 85% and particle diameters to be analyzed limited to ones each corresponding to a circle-equivalent diameter of 2.00 μm or more to 200.00 μm or less.

Prior to the initiation of the measurement, automatic focusing is performed by using standard latex particles (obtained by diluting, for example, 5200A manufactured by Duke Scientific with ion-exchanged water). After that, focusing is preferably performed every two hours from the initiation of the measurement.

It should be noted that, in each example of the present application, a flow-type particle image analyzer which had been subjected to a calibration operation by SYSMEX CORPORATION, and which had received a calibration certificate issued by SYSMEX CORPORATION was used, and the measurement was performed under measurement and analysis conditions identical to those at the time of the reception of the calibration certificate except that particle diameters to be analyzed were limited to ones each corresponding to a circle-equivalent diameter of 2.00 μm or more to 200.00 μm or less.

(Evaluation of Toner for Storage Stability)

5.0 g of toner were weighed in a polycup. The polycup was left in a thermostat set at each of 45° C. and 50° C. for 7 days. Visual evaluation was performed on the basis of the following criteria.

A: The fluidity of the toner is substantially identical to that before the leaving at each of 45° C. and 50° C.

B: The fluidity of the toner is substantially identical to that before the leaving at 45° C., but an aggregate of 2 mm or less in size that can be collapsed with a finger is observed at 50° C.

C: An aggregate of 2 mm or less in size is observed at 45° C., and an aggregate of 5 mm or less in size is observed at 50° C., but the aggregates can be collapsed with a finger.

D: An aggregate of more than 5 mm in size is observed at each of 45° C. and 50° C., and the aggregate cannot be collapsed with a finger.

E: An aggregate of more than 10 mm in size is observed at each of 45° C. and 50° C., and the aggregate cannot be collapsed with a finger.

Hereinafter, the present invention will be described in more detail by way of specific production examples and examples. However, the present invention is by no means limited to these examples.

Low-Softening-Point Resin Production Example 1

5 parts by mass of styrene, 2.5 parts by mass of 2-ethylhexyl acrylate, 1 part by mass of fumaric acid, and 2.5 parts by mass of a dimer of α-methylstyrene as materials for a vinyl-based copolymer, and dicumyl peroxide were loaded into a dropping funnel. In addition, 30 parts by mass of polyoxypropylene(2.2)-2,2-bis(4-hydroxyphenyl)propane, 20 parts by mass of polyoxyethylene(2.2)-2,2-bis(4-hydroxyphenyl)propane, 10 parts by mass of terephthalic acid, 5 parts by mass of trimellitic anhydride, 24 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. After the inside of the four-necked flask had been replaced with a nitrogen gas, a temperature inside the flask was gradually increased while the mixture in the flask was stirred. While the mixture was stirred at a temperature of 130° C., the monomers of a vinyl-based copolymer shown in Table 2, a crosslinking agent, and a polymerization initiator were dropped to the mixture over about 4 hours from the foregoing dropping funnel. Next, the temperature inside the flask was increased to 200° C., and the mixture was subjected to a reaction for 2 hours, whereby Low-Softening-Point Resin (L-1) was obtained. Table 2 shows the constitution of the resultant low-softening-point resin, and Table 4 shows the physical properties of the resin.

Low-Softening-Point Resin Production Example 2

10 parts by mass of styrene, 5 parts by mass of 2-ethylhexyl acrylate, 2 parts by mass of fumaric acid, and 5 parts by mass of a dimer of α-methylstyrene as materials for a vinyl-based copolymer, and dicumyl peroxide were loaded into a dropping funnel. In addition, 25 parts by mass of polyoxypropylene(2.2)-2,2-bis(4-hydroxyphenyl)propane, 15 parts by mass of polyoxyethylene(2.2)-2,2-bis(4-hydroxyphenyl)propane, 10 parts by mass of terephthalic acid, 5 parts by mass of trimellitic anhydride, 23 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. After the inside of the four-necked flask had been replaced with a nitrogen gas, a temperature inside the flask was gradually increased while the mixture in the flask was stirred. While the mixture was stirred at a temperature of 130° C., the monomers of a vinyl-based copolymer shown in Table 2, a crosslinking agent, and a polymerization initiator were dropped to the mixture over about 4 hours from the foregoing dropping funnel. Next, the temperature inside the flask was increased to 200° C., and the mixture was subjected to a reaction for 2 hours, whereby Low-Softening-Point Resin (L-2) was obtained. Table 2 shows the constitution of the resultant low-softening-point resin, and Table 4 shows the physical properties of the resin.

Low-Softening-Point Resin Production Example 3

30 parts by mass of polyoxypropylene(2.2)-2,2-bis(4-hydroxyphenyl)propane, 20 parts by mass of polyoxyethylene (2.2)-2,2-bis(4-hydroxyphenyl)propane, 20 parts by mass of terephthalic acid, 3 parts by mass of trimellitic anhydride, 27 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. Under a nitrogen atmosphere, the mixture in the flask was subjected to a reaction at 210° C. for 2 hours, whereby a polyester resin was obtained.

Next, di-tert-butyl peroxide was added to the mixture of 83 parts by mass of styrene and 1 part by mass of n-butyl acrylate, and the whole was dropped to 200 parts by mass of heated xylene over 4 hours. Further, the resultant was subjected to a polymerization reaction under xylene reflux for 2 hours, and the solvent was removed by distillation while the temperature of the resultant was heated to 200° C. under reduced pressure, whereby a styrene-acrylic resin was obtained.

80 parts by mass of the above polyester resin thus obtained and 20 parts by mass of the styrene-acrylic resin thus obtained were mixed with a Henschel mixer, whereby Low-Softening-Point Resin (L-3) was obtained. Table 2 shows the constitution of the resultant low-softening-point resin, and Table 4 shows the physical properties of the resin.

Low-Softening-Point Resin Production Examples 4 and 5

Low-Softening-Point Resins (L-4) and (L-5) were each obtained in the same manner as in Low-Softening-Point Resin Production Example 3 except that a mixing ratio between the resultant polyester resin and the resultant styrene-acrylic resin in Low-Softening-Point Resin Production Example 3 was changed to that shown in Table 2. Table 2 shows the constitutions of the resultant low-softening-point resins, and Table 4 shows the physical properties of the resins.

Low-Softening-Point Resin Production Example 6

30 parts by mass of polyoxypropylene(2.2)-2,2-bis(4-hydroxyphenyl)propane, 20 parts by mass of polyoxyethylene (2.2)-2,2-bis(4-hydroxyphenyl)propane, 20 parts by mass of terephthalic acid, 3 parts by mass of trimellitic anhydride, 27 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. Under a nitrogen atmosphere, the mixture in the flask was subjected to a reaction at 210° C. for 1 hour, whereby Low-Softening-Point Resin (L-6) was obtained. Table 2 shows the constitution of the resultant low-softening-point resin, and Table 4 shows the physical properties of the resin.

High-Softening-Point Resin Production Example 1

10 parts by mass of styrene, 5 parts by mass of 2-ethylhexyl acrylate, 2 parts by mass of fumaric acid, and 5 parts by mass of a dimer of α-methylstyrene as materials for a vinyl-based copolymer, and dicumyl peroxide were loaded into a dropping funnel. In addition, 25 parts by mass of polyoxypropylene(2.2)-2,2-bis(4-hydroxyphenyl)propane, 15 parts by mass of polyoxyethylene(2.2)-2,2-bis(4-hydroxyphenyl)propane, 10 parts by mass of terephthalic acid, 5 parts by mass of trimellitic anhydride, 23 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. After the inside of the four-necked flask had been replaced with a nitrogen gas, a temperature inside the flask was gradually increased while the mixture in the flask was stirred. While the mixture was stirred at a temperature of 130° C., the monomers of a vinyl-based copolymer shown in Table 3, a crosslinking agent, and a polymerization initiator were dropped to the mixture over about 4 hours from the foregoing dropping funnel. Next, the temperature inside the flask was increased to 200° C., and the mixture was subjected to a reaction for 5 hours, whereby High-Softening-Point Resin (H-1) was obtained. Table 3 shows the constitution of the resultant high-softening-point resin, and Table 5 shows the physical properties of the resin.

High-Softening-Point Resin Production Example 2

10 parts by mass of styrene, 5 parts by mass of 2-ethylhexyl acrylate, 2 parts by mass of fumaric acid, and 5 parts by mass of a dimer of α-methylstyrene as materials for a vinyl-based copolymer, and dicumyl peroxide were loaded into a dropping funnel. In addition, 25 parts by mass of polyoxypropylene(2.2)-2,2-bis(4-hydroxyphenyl)propane, 15 parts by mass of polyoxyethylene(2.2)-2,2-bis(4-hydroxyphenyl)propane, 10 parts by mass of terephthalic acid, 5 parts by mass of trimellitic anhydride, 5 parts by mass of adipic acid, 18 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. After the inside of the four-necked flask had been replaced with a nitrogen gas, a temperature inside the flask was gradually increased while the mixture in the flask was stirred. While the mixture was stirred at a temperature of 130° C., the monomers of a vinyl-based copolymer shown in Table 3, a crosslinking agent, and a polymerization initiator were dropped to the mixture over about 4 hours from the foregoing dropping funnel. Next, the temperature inside the flask was increased to 200° C., and the mixture was subjected to a reaction for 5 hours, whereby High-Softening-Point Resin (H-2) was obtained. Table 3 shows the constitution of the resultant high-softening-point resin, and Table 5 shows the physical properties of the resin.

High-Softening-Point Resin Production Example 3

15 parts by mass of styrene, 7.5 parts by mass of 2-ethylhexyl acrylate, 3 parts by mass of fumaric acid, and 7.5 parts by mass of a dimer of α-methylstyrene as materials for a vinyl-based copolymer, and dicumyl peroxide were loaded into a dropping funnel. In addition, 20 parts by mass of polyoxypropylene(2.2)-2,2-bis(4-hydroxyphenyl)propane, 15 parts by mass of polyoxyethylene(2.2)-2,2-bis(4-hydroxyphenyl)propane, 10 parts by mass of terephthalic acid, 5 parts by mass of trimellitic anhydride, 5 parts by mass of adipic acid, 12 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. After the inside of the four-necked flask had been replaced with a nitrogen gas, a temperature inside the flask was gradually increased while the mixture in the flask was stirred. While the mixture was stirred at a temperature of 130° C., the monomers of a vinyl-based copolymer shown in Table 3, a crosslinking agent, and a polymerization initiator were dropped to the mixture over about 4 hours from the foregoing dropping funnel. Next, the temperature inside the flask was increased to 200° C., and the mixture was subjected to a reaction for 5 hours, whereby High-Softening-Point Resin (H-3) was obtained. Table 3 shows the constitution of the resultant high-softening-point resin, and Table 5 shows the physical properties of the resin.

High-Softening-Point Resin Production Examples 4 and 5

30 parts by mass of polyoxypropylene(2.2)-2,2-bis(4-hydroxyphenyl)propane, 20 parts by mass of polyoxyethylene (2.2)-2,2-bis(4-hydroxyphenyl)propane, 20 parts by mass of terephthalic acid, 3 parts by mass of trimellitic anhydride, 27 parts by mass of fumaric acid, and dibutyltin oxide were loaded into a 4-liter four-necked flask made of glass. A temperature gauge, a stirring rod, a condenser, and a nitrogen introducing pipe were attached to the four-necked flask, and the four-necked flask was placed in a mantle heater. Under a nitrogen atmosphere, the mixture in the flask was subjected to a reaction at 210° C. for 5 hours, whereby a polyester resin was obtained.

Next, di-tert-butyl peroxide was added to the mixture of 83 parts by mass of styrene and 1 part by mass of n-butyl acrylate, and the whole was dropped to 200 parts by mass of heated xylene over 4 hours. Further, the resultant was subjected to a polymerization reaction under xylene reflux for 5 hours, and the solvent was removed by distillation while the temperature of the resultant was heated to 200° C. under reduced pressure, whereby a styrene-acrylic resin was obtained.

The above polyester resin thus obtained and the styrene-acrylic resin thus obtained were mixed with a Henschel mixer such that the constitution ratios of the polyester resin to the styrene-acrylic resin were to be the ratios shown in Table 3, whereby High-Softening-Point Resins (H-4) and (H-5) were obtained. Table 3 shows the constitution of the resultant low-softening-point resin, and Table 5 shows the physical properties of the resin.

Middle-Softening-Point Resin Production Example 1

Middle-Softening-Point Resin (M-1) was produced in the same manner as in Low-Softening-Point Resin Production Example 1 except that the reaction time was changed from 2 hours to 3 hours. Table 6 shows the physical properties of Middle-Softening-Point Resin (M-1) obtained here.

Middle-Softening-Point Resin Production Example 2

Middle-Softening-Point Resin (M-2) was produced in the same manner as in Low-Softening-Point Resin Production Example 2 except that the reaction time was changed from hours to 3 hours. Table 6 shows the physical properties of Middle-Softening-Point Resin (M-2) obtained here.

It should be noted that, in Tables 4 to 6, Mp represents the molecular weight at which a main peak in the molecular weight distribution of a resin by GPC measurement is placed, and Tg represents the glass transition temperature of the resin.

Table 2

TABLE 2

List of material constitutions of low-softening-point resins

| | Constitution of polyester unit | Constitution of vinyl-based polymer unit | Constitution ratio (composition ratio) of polyester unit to vinyl-based polymer unit |
|---|---|---|---|
| (L-1) | PO-BPA, EO-BPA TPA, FA, TMA | St, 2EHA α-methylstyrene | 90/10 |
| (L-2) | PO-BPA, EO-BPA TPA, FA, TMA | St, 2EHA α-methylstyrene | 80/20 |
| (L-3) | PO-BPA, EO-BPA TPA, FA, TMA | St, BA | 80/20 |
| (L-4) | PO-BPA, EO-BPA TPA, FA, TMA | St, BA | 85/15 |
| (L-5) | PO-BPA, EO-BPA TPA, FA, TMA | St, BA | 50/50 |
| (L-6) | PO-BPA, EO-BPA TPA, FA, TMA | None | 100/0 |

PO-BPA: Propylene oxide adduct of bisphenol A
EO-BPA: Ethylene oxide adduct of bisphenol A
FA: Fumaric acid
TPA: Terephthalic acid
TMA: Trimellitic anhydride Adipic acid
St: Styrene
2-EHA: 2-ethylhexyl acrylate
α-methylstyrene
BA: Butyl acrylate Table 3

TABLE 3

List of material constitutions of high-softening-point resins

| | Constitution of polyester unit | Constitution of vinyl-based polymer unit | Constitution ratio (composition ratio) of polyester unit to vinyl-based polymer unit |
|---|---|---|---|
| (H-1) | PO-BPA, EO-BPA TPA, FA, TMA | St, 2EHA α-methylstyrene | 80/20 |
| (H-2) | PO-BPA, EO-BPA TPA, FA, TMA, Adipic acid | St, 2EHA α-methylstyrene | 80/20 |
| (H-3) | PO-BPA, EO-BPA TPA, FA, TMA, Adipic acid | St, 2EHA α-methylstyrene | 70/30 |
| (H-4) | PO-BPA, EO-BPA TPA, FA, TMA | St, BA | 80/20 |
| (H-5) | PO-BPA, EO-BPA TPA, FA, TMA | St, BA | 60/40 |

PO-BPA: Propylene oxide adduct of bisphenol A
EO-BPA: Ethylene oxide adduct of bisphenol A
FA: Fumaric acid
TPA: Terephthalic acid
TMA: Trimellitic anhydride Adipic acid
St: Styrene
2-EHA: 2-ethylhexyl acrylate
α-methylstyrene
BA: Butyl acrylate Table 4

TABLE 4

List of physical properties of low-softening-point resins

| | Molecular weight distribution by GPC measurement | | Results of measurement with flow tester | | |
|---|---|---|---|---|---|
| | | | Temperature at which resin starts to flow out | Softening point Tm | Glass transition temperature Tg |
| | Mp | Mw/Mn | Tfb (° C.) | (° C.) | (° C.) |
| (L-1) | 3139 | 2.8 | 74.5 | 84.8 | 43.6 |
| (L-2) | 3542 | 3.2 | 78.3 | 96.8 | 52.6 |
| (L-3) | 6600 | 58 | 90.3 | 108.3 | 62.3 |
| (L-4) | 5100 | 42 | 86.3 | 101.2 | 58.3 |
| (L-5) | 11500 | 102 | 91.5 | 109.5 | 63.4 |
| (L-6) | 1800 | 1.5 | 67.6 | 79.5 | 40.2 |

Table 5

TABLE 5

List of physical properties of high-softening-point resins

| | Molecular weight distribution by GPC measurement | | Results of measurement with flow tester | | |
|---|---|---|---|---|---|
| | | | Temperature at which resin starts to flow out | Softening point Tm | Glass transition temperature Tg |
| | Mp | Mw/Mn | Tfb (° C.) | (° C.) | (° C.) |
| (H-1) | 8083 | 191 | 102.1 | 134.6 | 65.2 |
| (H-2) | 8500 | 211 | 107.4 | 139.8 | 64.3 |
| (H-3) | 8905 | 220 | 111.8 | 142.3 | 65.6 |
| (H-4) | 7200 | 98 | 97.3 | 128.5 | 59.8 |
| (H-5) | 12600 | 260 | 117.3 | 146.7 | 70.2 |

Table 6

TABLE 6

List of physical properties of middle-softening-point resins

| | Molecular weight distribution by GPC measurement | | Results of measurement with flow tester | | |
|---|---|---|---|---|---|
| | | | Temperature at which resin starts to flow out | Softening point Tm | Glass transition temperature Tg |
| | Mp | Mw/Mn | Tfb (° C.) | (° C.) | (° C.) |
| (M-1) | 4900 | 24 | 80.1 | 98.2 | 54.5 |
| (M-2) | 6050 | 38 | 90.7 | 108.5 | 63.1 |

Master Batch Production Example 1

Master Batch (P-1) was produced by using the following materials and the following production method.

| | |
|---|---|
| Middle-Softening-Point Resin (M-1) | 50 parts by mass |
| C.I. Pigment Blue 15:3 | 50 parts by mass |

The above materials were mixed with a Henschel mixer (FM-75 type, manufactured by Mitsui Miike Machinery Co., Ltd.), and then the mixture was melted and kneaded with a biaxial extruder (PCM-30 type, manufactured by Ikegai, Ltd.) having a temperature set to 120° C. The resultant kneaded product was cooled, and was coarsely pulverized into pieces each having a size of 1 mm or less with a hammer mill, whereby Master Batch (P-1) was obtained.

Master Batch Production Example 2

Master Batch (P-2) was produced by using the following materials and the following production method.

| | |
|---|---|
| Middle-Softening-Point Resin (M-2) | 50 parts by mass |
| C.I. Pigment Blue 15:3 | 50 parts by mass |

The above materials were mixed with a Henschel mixer (FM-75 type, manufactured by Mitsui Miike Machinery Co., Ltd.), and then the mixture was melted and kneaded with a biaxial extruder (PCM-30 type, manufactured by Ikegai, Ltd.) having a temperature set to 120° C. The resultant kneaded product was cooled, and was coarsely pulverized into pieces each having a size of 1 mm or less with a hammer mill, whereby Master Batch (P-2) was obtained.

Table 7

TABLE 7

List of master batches

| | Middle-softening-point resin | | Pigment | |
|---|---|---|---|---|
| | Kind | Compounding ratio | Kind | Compounding ratio |
| (P-1) | (M-1) | 50 | C.I. Pigment blue 15:3 | 50 |
| (P-2) | (M-2) | 50 | C.I. Pigment blue 15:3 | 50 |

Toner Production Example 1

Toner (T-1) was produced by using the following materials and the following production method.

| | |
|---|---|
| Low-Softening-Point Resin (L-1) | 50 parts by mass |
| High-Softening-Point Resin (H-1) | 50 parts by mass |
| Master Batch (P-1) | 10 parts by mass |
| Normal paraffin wax (W-1: melting point 75° C.) | 7 parts by mass |
| Aluminum 3,5-di-t-butylsalicylate compound (C-1) | 0.7 part by mass |

The above materials were mixed with a Henschel mixer (FM-75 type, manufactured by Mitsui Miike Machinery Co., Ltd.), and then the mixture was melted and kneaded with a biaxial extruder (PCM-30 type, manufactured by Ikegai, Ltd.) having a temperature set to 120° C. The resultant kneaded product was cooled, and was coarsely pulverized into pieces each having a size of 1 mm or less with a hammer mill, whereby a toner coarsely pulverized product was obtained. The resultant toner coarsely pulverized product was finely pulverized with such mechanical pulverizer as shown in FIG. 12. The toner coarsely pulverized product was pulverized with the number of revolutions of a rotator set to 120 $s^{-1}$.

Next, the resultant finely pulverized product was subjected to a surface treatment with such surface modification treatment apparatus as shown in FIG. 14 for 60 seconds with the number of revolutions of a dispersion rotor set to 100 $s^{-1}$ (corresponding to a rotation circumferential speed of 130 m/sec) while fine particles were removed from the product with the number of revolutions of a classification rotor set to 120 $s^{-1}$. As a result, toner particles were obtained.

Figure 15:
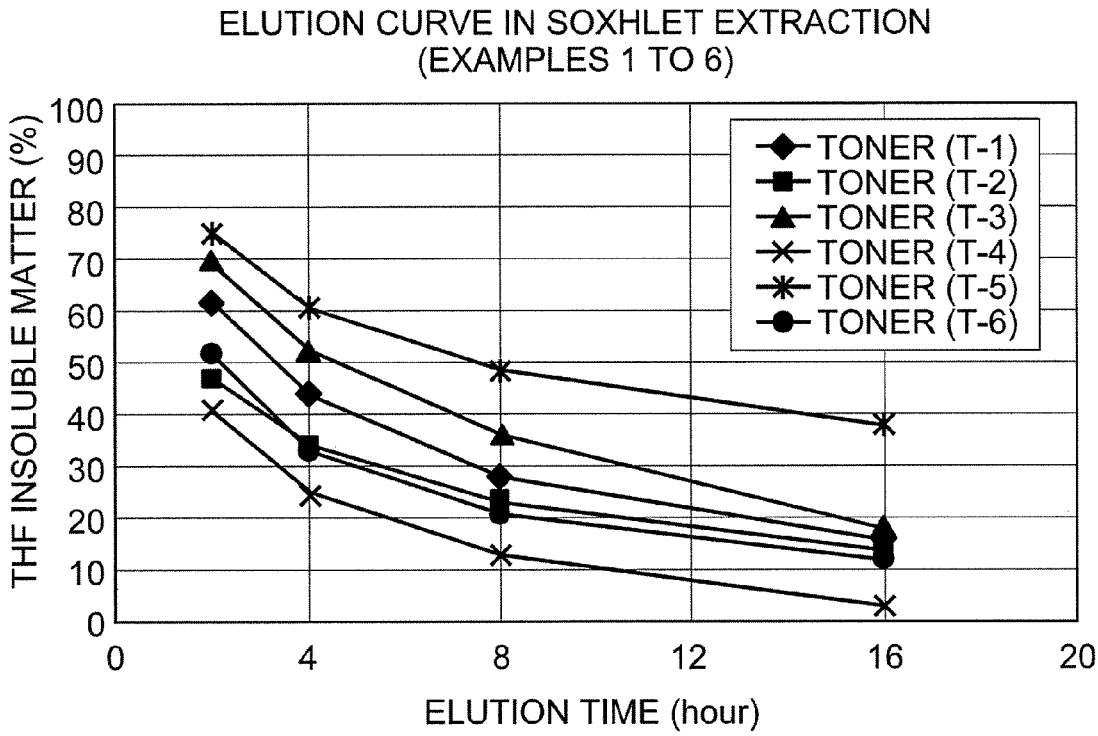
FIG. 15 is the elution curve in Soxhlet extraction with THF of a toner used in each of Examples 1 to 6.

Then, 1.0 mass % of anatase type titanium oxide having a BET specific surface area of 100 $m^2/g$ and 1.0 mass % of hydrophobic silica having a BET specific surface area of 130 $m^2/g$ were added to 100 parts by mass of the resultant toner particles, and the whole was mixed with a Henschel mixer (FM-75 type, manufactured by Mitsui Miike Machinery Co., Ltd.) at a number of revolutions of 30 $s^{-1}$ for 10 minutes, whereby Toner (T-1) was obtained. Table 8 shows the constitution of Toner (T-1) obtained here, Table 9 shows the physical properties of the toner, and FIG. 15 shows Graph 1 of the toner.

Toner Production Example 2

Toner (T-2) was produced by using the following materials and the following production method.

| | |
|---|---|
| Low-Softening-Point Resin (L-1) | 70 parts by mass |
| High-Softening-Point Resin (H-2) | 30 parts by mass |
| Master Batch (P-1) | 10 parts by mass |
| Ester wax (W-2: melting point 85° C.) | 7 parts by mass |
| Aluminum 3,5-di-t-butylsalicylate compound (C-1) | 0.9 part by mass |

Toner (T-2) was obtained in the same manner as in Toner Production Example 1. Table 8 shows the constitution of Toner (T-2) obtained here, Table 9 shows the physical properties of the toner, and FIG. 15 shows Graph 1 of the toner.

Toner Production Example 3

Toner (T-3) was produced by using the following materials and the following production method.

| | |
|---|---|
| Low-Softening-Point Resin (L-2) | 70 parts by mass |
| High-Softening-Point Resin (H-2) | 30 parts by mass |
| Master Batch (P-2) | 10 parts by mass |
| Normal paraffin wax (W-3: melting point 65° C.) | 7 parts by mass |
| Aluminum 3,5-di-t-butylsalicylate compound (C-1) | 0.5 part by mass |

Toner (T-3) was obtained in the same manner as in Toner Production Example 1. Table 8 shows the constitution of Toner (T-3) obtained here, Table 9 shows the physical properties of the toner, and FIG. 15 shows Graph 1 of the toner.

Toner Production Example 4

Toner (T-4) was produced by using the following materials and the following production method.

| | |
|---|---|
| Low-Softening-Point Resin (L-1) | 90 parts by mass |
| High-Softening-Point Resin (H-1) | 10 parts by mass |
| Master Batch (P-1) | 10 parts by mass |
| Sasol wax (W-4: melting point 108° C.) | 7 parts by mass |
| Aluminum 3,5-di-t-butylsalicylate compound (C-1) | 0.9 part by mass |

Toner (T-4) was obtained in the same manner as in Toner Production Example 1. Table 8 shows the constitution of Toner (T-4) obtained here, Table 9 shows the physical properties of the toner, and FIG. 15 shows Graph 1 of the toner.

Toner Production Example 5

Toner (T-5) was produced by using the following materials and the following production method.

| | |
|---|---|
| Low-Softening-Point Resin (L-2) | 50 parts by mass |
| High-Softening-Point Resin (H-3) | 50 parts by mass |
| Master Batch (P-2) | 10 parts by mass |
| Normal paraffin wax (W-5: melting point 52° C.) | 7 parts by mass |
| Aluminum 3,5-di-t-butylsalicylate compound (C-1) | 0.5 part by mass |

Toner (T-5) was obtained in the same manner as in Toner Production Example 1. Table 8 shows the constitution of Toner (T-5) obtained here, Table 9 shows the physical properties of the toner, and FIG. 15 shows Graph 1 of the toner.

Toner Production Example 6

Toner (T-6) was produced by using the following materials and the following production method.

| | |
|---|---|
| Low-Softening-Point Resin (L-1) | 90 parts by mass |
| High-Softening-Point Resin (H-1) | 10 parts by mass |
| Master Batch (P-1) | 10 parts by mass |
| Sasol wax (W-4: melting point 108° C.) | 7 parts by mass |
| Aluminum 3,5-di-t-butylsalicylate compound (C-1) | 1.8 part by mass |

Toner (T-6) was obtained in the same manner as in Toner Production Example 1. Table 8 shows the constitution of Toner (T-6) obtained here, Table 9 shows the physical properties of the toner, and FIG. 15 shows Graph 1 of the toner.

Toner Production Example 7

Toner (t-1) was produced by using the following materials and the following production method.

| | |
|---|---|
| Low-Softening-Point Resin (L-3) | 30 parts by mass |
| High-Softening-Point Resin (H-4) | 70 parts by mass |
| C.I. Pigment Blue 15:3 | 5 parts by mass |
| Normal paraffin wax (W-1: melting point 75° C.) | 7 parts by mass |
| Aluminum 3,5-di-t-butylsalicylate compound (C-1) | 0.5 part by mass |

The above materials were mixed with a Henschel mixer (FM-75 type, manufactured by Mitsui Miike Machinery Co., Ltd.), and then the mixture was melted and kneaded with a biaxial extruder (PCM-30 type, manufactured by Ikegai, Ltd.) having a temperature set to 160° C. The resultant kneaded product was cooled, and was coarsely pulverized into pieces each having a size of 1 mm or less with a hammer mill, whereby a toner coarsely pulverized product was obtained. The resultant toner coarsely pulverized product was finely pulverized with such mechanical pulverizer as shown in FIG. 12. The toner coarsely pulverized product was pulverized with the number of revolutions of a rotator set to 120 $s^{-1}$.

Next, the resultant finely pulverized product was subjected to a surface treatment with such surface modification treatment apparatus as shown in FIG. 14 for 60 seconds with the number of revolutions of a dispersion rotor set to 100 $s^{-1}$ (corresponding to a rotation circumferential speed of 130 m/sec) while fine particles were removed from the product with the number of revolutions of a classification rotor set to 120 $s^{-1}$. As a result, toner particles were obtained.

Figure 16:
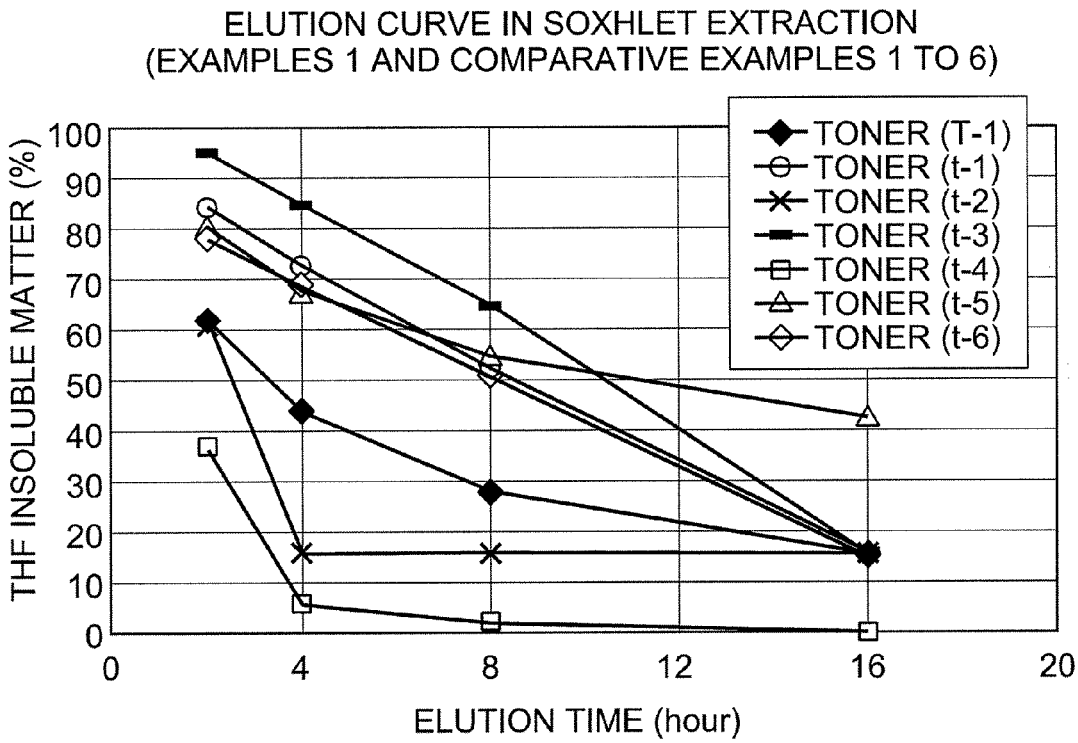
FIG. 16 is the elution curve in Soxhlet extraction with THF of a toner used in each of Example 1 and Comparative Examples 1 to 6.

Then, 1.0 mass % of anatase type titanium oxide having a BET specific surface area of 100 $m^2/g$ and 1.0 mass % of hydrophobic silica having a BET specific surface area of 130 $m^2/g$ were added to 100 parts by mass of the resultant toner particles, and the whole was mixed with a Henschel mixer (FM-75 type, manufactured by Mitsui Miike Machinery Co., Ltd.) at a number of revolutions of 30 $s^{-1}$ for 10 minutes, whereby Toner (t-1) was obtained. Table 8 shows the constitution of Toner (t-1) obtained here, Table 9 shows the physical properties of the toner, and FIG. 16 shows Graph 2 of the toner.

Toner Production Example 8

Toner (t-2) was produced by using the following materials and the following production method.

| | |
|---|---|
| Low-Softening-Point Resin (L-4) | 100 parts by mass |
| C.I. Pigment Blue 15:3 | 5 parts by mass |
| Normal paraffin wax (W-1: melting point 75° C.) | 7 parts by mass |
| Aluminum 3,5-di-t-butylsalicylate compound (C-1) | 0.5 part by mass |

The above materials were mixed with a Henschel mixer (FM-75 type, manufactured by Mitsui Miike Machinery Co., Ltd.), and then the mixture was melted and kneaded with a biaxial extruder (PCM-30 type, manufactured by Ikegai, Ltd.) having a temperature set to 160° C. The resultant kneaded product was cooled, and was coarsely pulverized into pieces each having a size of 1 mm or less with a hammer mill, whereby a toner coarsely pulverized product was obtained. The resultant toner coarsely pulverized product was finely pulverized with such mechanical pulverizer as shown in FIG. 12. The toner coarsely pulverized product was pulverized with the number of revolutions of a rotator set to 120 $s^{-1}$.

Next, the resultant finely pulverized product was formed into toner particles by using an airflow type air classifier (Elbow jet, manufactured by Matsubo Corporation).

Then, 1.0 mass % of anatase type titanium oxide having a BET specific surface area of 100 $m^2/g$ and 1.0 mass % of hydrophobic silica having a BET specific surface area of 130 $m^2/g$ were added to 100 parts by mass of the resultant toner particles, and the whole was mixed with a Henschel mixer (FM-75 type, manufactured by Mitsui Miike Machinery Co., Ltd.) at a number of revolutions of 30 $s^{-1}$ for 10 minutes, whereby Toner (t-2) was obtained. Table 8 shows the constitution of Toner (t-2) obtained here, Table 9 shows the physical properties of the toner, and FIG. 16 shows Graph 2 of the toner.

Toner Production Example 9

Toner (t-3) was produced by using the following materials and the following production method.

| | |
|---|---|
| Low-Softening-Point Resin (L-5) | 30 parts by mass |
| High-Softening-Point Resin (H-5) | 70 parts by mass |
| C.I. Pigment Blue 15:3 | 5 parts by mass |
| Normal paraffin wax (W-1: melting point 75° C.) | 7 parts by mass |
| Aluminum 3,5-di-t-butylsalicylate compound (C-1) | 0.5 part by mass |

Toner (t-3) was obtained in the same manner as in Toner Production Example 7. Table 8 shows the constitution of Toner (t-3) obtained here, Table 9 shows the physical properties of the toner, and FIG. 16 shows Graph 2 of the toner.

Toner Production Example 10

Toner (t-4) was produced by using the following materials and the following production method.

| | |
|---|---|
| Low-Softening-Point Resin (L-6) | 90 parts by mass |
| High-Softening-Point Resin (H-4) | 10 parts by mass |
| C.I. Pigment Blue 15:3 | 5 parts by mass |
| Normal paraffin wax (W-1: melting point 75° C.) | 7 parts by mass |
| Aluminum 3,5-di-t-butylsalicylate compound (C-1) | 0.5 part by mass |

Toner (t-4) was obtained in the same manner as in Toner Production Example 7. Table 8 shows the constitution of Toner (t-4) obtained here, Table 9 shows the physical properties of the toner, and FIG. 16 shows Graph 2 of the toner.

Toner Production Example 11

Toner (t-5) was produced by using the following materials and the following production method.

| | |
|---|---|
| Low-Softening-Point Resin (L-3) | 30 parts by mass |
| High-Softening-Point Resin (H-5) | 70 parts by mass |
| C.I. Pigment Blue 15:3 | 5 parts by mass |
| Normal paraffin wax (W-1: melting point 75° C.) | 7 parts by mass |
| Aluminum 3,5-di-t-butylsalicylate compound (C-1) | 0.5 part by mass |

Toner (t-5) was obtained in the same manner as in Toner Production Example 7. Table 8 shows the constitution of Toner (t-5) obtained here, Table 9 shows the physical properties of the toner, and FIG. 16 shows Graph 2 of the toner.

Toner Production Example 12

Toner (t-6) was produced by using the following materials and the following production method.

| | |
|---|---|
| Middle-Softening-Point Resin (M-2) | 100 parts by mass |
| Master Batch (P-1) | 10 parts by mass |
| Normal paraffin wax (W-1: melting point 75° C.) | 7 parts by mass |
| Aluminum 3,5-di-t-butylsalicylate compound (C-1) | 0.7 part by mass |

Toner (t-6) was obtained in the same manner as in Toner Production Example 1. Table 8 shows the constitution of Toner (t-6) obtained here, Table 9 shows the physical properties of the toner, and FIG. 16 shows Graph 2 of the toner.

Table 8

TABLE 8

List of material constitutions of toners

| | Binder resin | | | | | | | Particle size distribution | | |
|---|---|---|---|---|---|---|---|---|---|---|
| | Low-softening-point resin | Compounding ratio | High-softening-point resin | Compounding ratio | Colorant | Release agent | Charge control agent | D4 (μm) | D1 4 μm↓ (%) | Average circularity in FPIA 3000 |
| Toner (T-1) | (L-1) | 50 | (H-1) | 50 | (P-1) | (W-1) | (C-1) | 5.4 | 16.3 | 0.967 |
| Toner (T-2) | (L-1) | 70 | (H-2) | 30 | (P-1) | (W-2) | (C-1) | 5.1 | 18.6 | 0.976 |
| Toner (T-3) | (L-2) | 70 | (H-2) | 30 | (P-2) | (W-3) | (C-1) | 5.5 | 14.9 | 0.958 |
| Toner (T-4) | (L-1) | 90 | (H-1) | 10 | (P-1) | (W-4) | (C-1) | 4.9 | 19.8 | 0.986 |
| Toner (T-5) | (L-2) | 50 | (H-3) | 50 | (P-2) | (W-5) | (C-1) | 5.6 | 14.2 | 0.948 |
| Toner (T-6) | (L-1) | 90 | (H-1) | 10 | (P-1) | (W-4) | (C-1) | 5.1 | 18.7 | 0.984 |
| Toner (t-1) | (L-3) | 30 | (H-4) | 70 | C.I. Pigment blue 15:3 | (W-1) | (C-1) | 5.5 | 24.8 | 0.944 |
| Toner (t-2) | (L-4) | 100 | None | — | C.I. Pigment blue 15:3 | (W-1) | (C-1) | 5.2 | 27.8 | 0.930 |
| Toner (t-3) | (L-5) | 30 | (H-5) | 70 | C.I. Pigment blue 15:3 | (W-1) | (C-1) | 6.0 | 22.3 | 0.927 |
| Toner (t-4) | (L-6) | 90 | (H-4) | 10 | C.I. Pigment blue 15:3 | (W-1) | (C-1) | 5.3 | 28.1 | 0.929 |
| Toner (t-5) | (L-3) | 30 | (H-5) | 70 | C.I. Pigment blue 15:3 | (W-1) | (C-1) | 5.8 | 24.6 | 0.931 |
| Toner (t-6) | Middle-Softening-Point Resin (M-2), Compounding Ratio: 100 | | | | (P-1) | (W-1) | (C-1) | 5.5 | 17.2 | 0.946 |

Table 9

TABLE 9

List of physical properties of toners

| | THF insoluble matter (%) of binder resins in toner in Soxhlet extraction (%) | | | | Temperature at which highest endothermic peak in DSC endothermic curve is placed (° C.) | Storage elastic modulus G' (dN/m$^2$) | Storage stability |
|---|---|---|---|---|---|---|---|
| | A (2 hours after) | B (4 hours after) | C (8 hours after) | D (16 hours after) | | | |
| Toner (T-1) | 62 | 44 | 28 | 16 | 75 | $1.2 \times 10^4$ | A |
| Toner (T-2) | 47 | 34 | 23 | 14 | 85 | $8.6 \times 10^3$ | A |
| Toner (T-3) | 70 | 53 | 36 | 18 | 65 | $5.9 \times 10^4$ | A |
| Toner (T-4) | 41 | 25 | 13 | 3 | 108 | $1.4 \times 10^3$ | B |
| Toner (T-5) | 75 | 61 | 49 | 38 | 52 | $9.2 \times 10^4$ | A |
| Toner (T-6) | 52 | 33 | 21 | 12 | 75 | $9.1 \times 10^3$ | A |
| Toner (t-1) | 85 | 73 | 53 | 16 | 75 | $2.1 \times 10^4$ | C |
| Toner (t-2) | 61 | 16 | 16 | 16 | 75 | $8.8 \times 10^2$ | E |
| Toner (t-3) | 95 | 85 | 65 | 16 | 75 | $3.6 \times 10^5$ | A |
| Toner (t-4) | 37 | 6 | 2 | 0.5 | 75 | $6.2 \times 10^2$ | E |
| Toner (t-5) | 81 | 68 | 55 | 43 | 75 | $1.8 \times 10^5$ | B |
| Toner (t-6) | 78 | 69 | 51 | 15 | 75 | $1.3 \times 10^4$ | A |

Coated Carrier Production Example

A magnetic fine particle-dispersed core was produced by using the following materials.

| | |
|---|---|
| Phenol | 10 parts by mass |
| Formaldehyde solution (37-mass % aqueous solution) | 6 parts by mass |
| Magnetite particles (number average particle diameter D1 = 0.28 μm, intensity of magnetization 75 Am$^2$/kg, specific resistance $5.5 \times 10^5$ Ω · cm) | 84 parts by mass |

The above materials, and 5 parts by mass of 28-mass % ammonia water and 10 parts by mass of water were loaded into a flask, and the whole was heated to 85° C. within 30 minutes and held at the temperature while being stirred and mixed. The resultant was subjected to a polymerization reaction for 3 hours so as to be cured. After that, the cured product was cooled to 30° C., and water was further added to the product. After that, the supernatant was removed. The precipitate was washed with water, and was then air-dried. Next, the resultant was dried under reduced pressure (5 hPa or less) at a temperature of 60° C., whereby a magnetic fine particle-dispersed core in which magnetic fine particles were dispersed was obtained.

Subsequently, 5 parts by mass of a methyl methacrylate macromer represented by the following formula, and having an ethylenically unsaturated group at one of its terminals and a weight average molecular weight of 5,000, 50 parts by mass of methyl methacrylate, and 50 parts by mass of cyclohexyl methacrylate were added to a four-necked flask provided with a reflux condenser, a temperature gauge, a nitrogen inhaling pipe, and a grinding type stirring device. Further, 100 parts by mass of toluene, 100 parts by mass of methyl ethyl ketone, and 2.5 parts by mass of azobisisovaleronitrile were added to the flask, and the whole was held at 80° C. for 10 hours in a stream of nitrogen, whereby a resin solution for a coating material (solid content 35 mass %) was obtained.

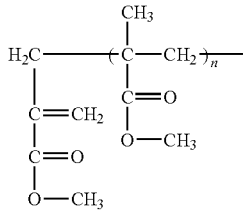

2 parts by mass of silicone particles (number average particle diameter 0.2 μm), 1 part by mass of carbon black (number average particle diameter 35 nm, DBP oil absorption 50 ml/100 g), and 70 parts by mass of toluene were dispersed in 30 parts by mass of the resultant resin solution for a coating material in a beads mill (RMH-03 type, manufactured by AIMEX CO., Ltd.) by using glass beads each having a bead diameter of 0.5 mm, where by a coating material was obtained.

Subsequently, 6 parts by mass of the coating material were sprayed with a spray nozzle on 100 parts by mass of the magnetic fine particle-dispersed core while the core was fluidized at 80° C. by using a fluidized bed coating device (SPIR-A-FLOW, manufactured by FREUND). After that, the solvent was volatilized and dried at 100° C. while the resultant was fluidized, whereby the surface of the core was coated with the coating material. The coated magnetic fine particle-dispersed core was classified with a screen having an aperture of 75 μm, whereby a coated carrier having a number average particle diameter of 35 μm, a specific resistance of $3.0 \times 10^8$ Ω·cm, a true specific gravity of 3.6 g/cm$^3$, an intensity of magnetization (σ1000) of 55.5 Am$^2$/kg, and a remanent magnetization of 5.5 Am$^2$/kg was obtained.

EXAMPLE 1

First, a developer was produced. 8 parts by mass of Toner (T-1) were added to 92 parts by mass of the above coated carrier, and the whole was mixed with a V type mixer, whereby a developer was obtained.

Next, such belt fixing unit as shown in FIG. 2 was used in evaluation for fixing ability. Fixing conditions were as follows: a fixation speed of 300 mm/sec, a fixing nip width of 30 mm, and a fixing nip pressure of 0.15 MPa.

A reconstructed device of a full-color copying machine IRC3220N manufactured by Canon Inc. was used in evaluation for developing ability and transferability. The copying machine was reconstructed so as to have a process speed of 300 mm/s and to be capable of outputting 70 sheets per minute. It should be noted that the reconstructed device of the IRC3220N was used also for outputting an image for evaluation for fixing ability.

An image was outputted and evaluated for each of fixing ability, developability, and transferability under one of a normal-temperature, normal-humidity environment (23° C., 50% RH), a normal-temperature, low-humidity environment (23° C., 5% RH), a low-temperature, low-humidity environment (15° C., 10% RH), and a high-temperature, high-humidity environment (30° C., 80% RH). It should be noted that evaluation items and evaluation criteria were shown below. Tables 10 12 and 14 show the obtained results of evaluation.

It should be noted that the above normal-temperature, normal-humidity environment, the above normal-temperature, low-humidity environment, the above low-temperature, low-humidity environment, and the above high-temperature, high-humidity environment may hereinafter be referred to as an N/N environment, an N/L environment, an L/L environment, and an H/H environment, respectively.

(Items of Evaluation for Fixability)

(Evaluations for Low-temperature Fixability, Gloss, and Chroma)

Figure 3:
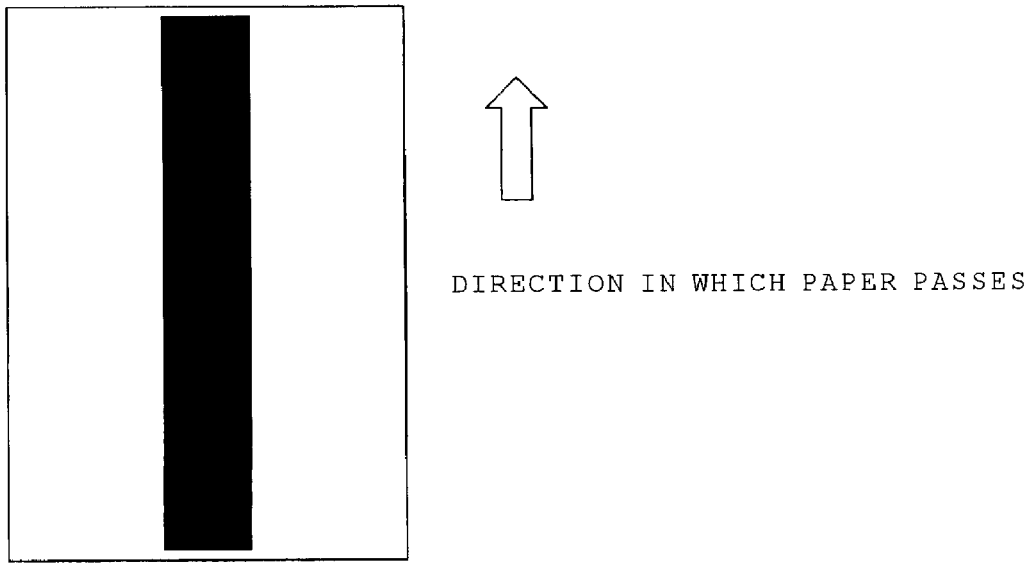
FIG. 3 is a schematic view showing an example of an image subjected to the evaluation of the toner of the present invention for fixing ability.

First, such A4 image as shown in FIG. 3 (printing ratio: 20%) and paper having a basis weight of 105 g/m$^2$ as a recording material were used. An image was outputted while a developing bias was adjusted so that a toner mounting amount on the recording material would be 1.2 mg/cm$^2$. The resultant image was subjected to moisture conditioning under an L/L environment for 24 hours.

Subsequently, the toner was evaluated for low-temperature fixability under the L/L environment. The image subjected to moisture conditioning was passed while the temperature of the fixing belt was increased in the range of 100 to 200° C. in an increment of 5° C.

The toner image portion of the passed image was reciprocated five times through a cylindrical roller having a size of ϕ60 mm×40 mm (made of brass: 798 g) to be folded in the shape of a cross. After having been opened, the image was rubbed ten times with lens-cleaning paper (Dusper K3-half cut, manufactured by OZU CORPORATION) wound around the section of a square polar weight measuring 22 mm long by 22 mm wide by 47 mm thick (made of brass: 198 g), and the temperature at which the toner image peeled by 25% or less was defined as a fixation temperature. The percentage by which the toner image peeled was measured with an image processing system (Personal IAS). In addition, in the evaluation of toner for gloss, the gloss value of the toner was measured by using an image that was passed when the temperature of a fixing belt was 160° C. The gloss value was measured with a glossmeter (PG-1, manufactured by NIPPON DENSHOKU) at a measurement angle of 60°.

In the evaluation of the toner for chroma, the chromaticity of the image used in the measurement of the gloss value was measured. The chromaticity was measured with a chromoscope (Spectrolino, manufactured by GRETAGMACBETH) and a D50 as an observation light source at an observation view angle of 2°.

(Evaluation for Hot Offset Property)

Figure 4:
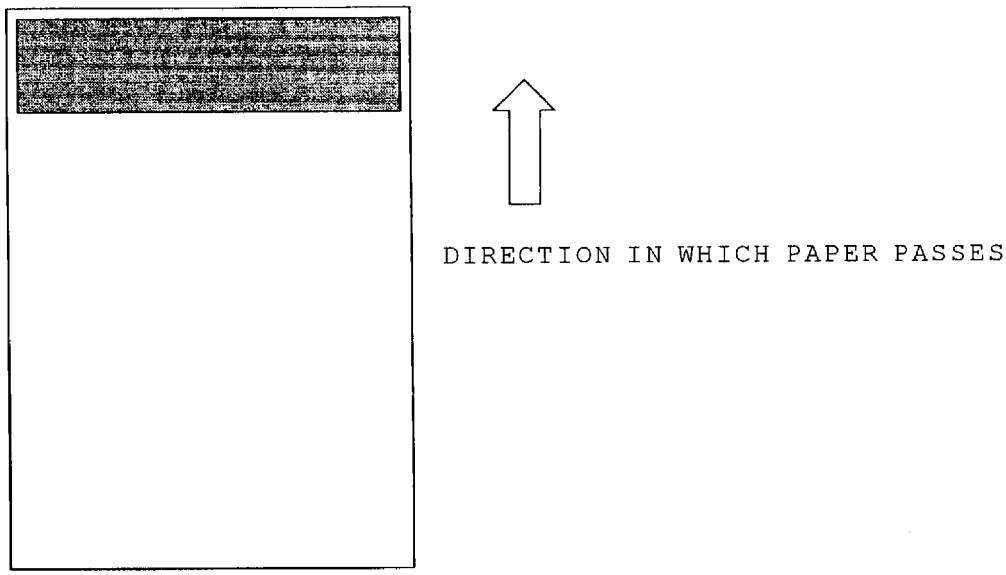
FIG. 4 is a schematic view showing an example of an image subjected to the evaluation of the toner of the present invention for fixing ability.

First, such A4 image as shown in FIG. 4 (printing ratio: 15%) and paper having a basis weight of 64 g/m$^2$ as a recording material were used. An image was outputted while a developing bias was adjusted so that a toner mounting amount on the recording material would be 0.2 mg/cm$^2$. The resultant image was subjected to moisture conditioning under an N/L environment for 24 hours.

Subsequently, the toner was evaluated for hot offset property under the N/L environment. The image subjected to moisture conditioning was passed while the temperature of the fixing belt was increased in the range of 120 to 220° C. in an increment of 5° C. The fogging density of a region except the toner image portion of the passed image was measured. The fogging density was measured with a reflection densitometer (TC-6DS, manufactured by Tokyo Denshoku), and the temperature at which a value obtained by subtracting the minimum value of the reflection density of the image from the maximum value of the reflection density became 0.5 or less was judged to be the temperature at which hot offset property was not problematic.

(Evaluation for Separability)

Figure 5:
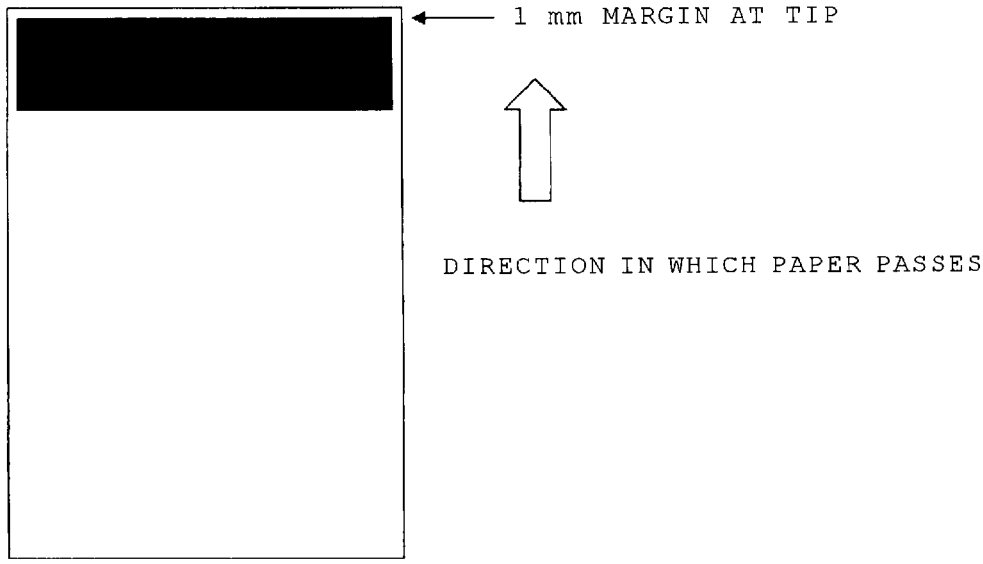
FIG. 5 is a schematic view showing an example of an image subjected to the evaluation of the toner of the present invention for fixing ability.

First, such A5 image as shown in FIG. 5 (printing ratio: 15%) and paper having a basis weight of 64 g/m$^2$ as a recording material were used. An image was outputted while a developing bias was adjusted so that a toner mounting amount on the recording material would be 1.2 mg/cm$^2$. The resultant image was subjected to moisture conditioning under an H/H environment for 24 hours.

Subsequently, the toner was evaluated for separability under the H/H environment. The image subjected to moisture conditioning was passed while the temperature of the fixing belt was increased in the range of 100 to 220° C. in an increment of 5° C. The temperature at which the image was discharged without being wound around the fixing belt upon passing was judged to be the temperature at which the image was separated. In addition, evaluation for separability was performed on the basis of the following criteria.

A: A temperature region in which the image is separated is placed at 70° C. or higher.

B: A temperature region in which the image is separated is placed at 50° C. or higher to less than 70° C.

C: A temperature region in which the image is separated is placed at 30° C. or higher to less than 50° C.

D: A temperature region in which the image is separated is placed at 10° C. or higher to less than 30° C.

E: A temperature region in which the image is separated is placed at less than 10° C.

(Items of Evaluation for Developing Ability and Transferability)

(Evaluation for Image Density)

Figure 6:
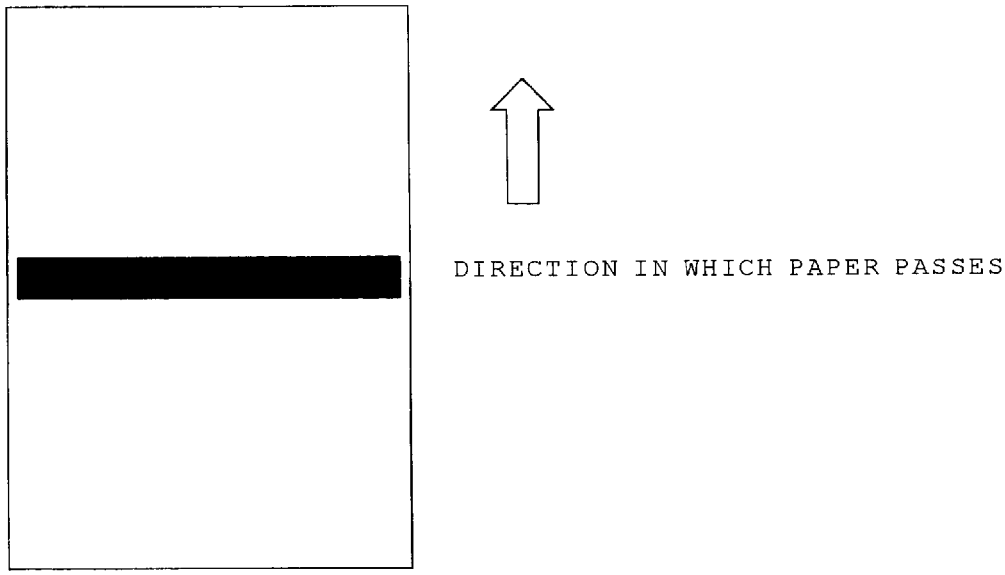
FIG. 6 is a schematic view showing an example of an image subjected to the evaluation of the toner of the present invention for developing ability and transferability.

First, such A4 image as shown in FIG. 6 (printing ratio: 10%) and paper having a basis weight of 80 g/m$^2$ as a recording material were used. Up to 10,000 images were outputted under each of N/N, N/L, and H/H environments while a developing bias was adjusted so that a toner mounting amount on the recording material would be 0.6 mg/cm$^2$. The densities of each of the resultant images at six points were measured with a densitometer X-Rite 500 type, and the average value of the six measured values was defined as an image density.

(Half Tone (HT) Uniformity)

Images were outputted under an H/H environment while a developing bias was adjusted so that a toner mounting amount on a recording material would be 0.3 mg/cm$^2$ at an initial stage of the image output and after the output of 10,000 sheets. The reflection densities of each of the resultant images at six points were measured with a reflection densitometer X-Rite 500 type, and the image was evaluated on the basis of the following criteria.

A: (Maximum value of six points)−(minimum value of six points) is less than 0.05.

B: (Maximum value of six points)−(minimum value of six points) is 0.05 or more to less than 0.10.

C: (Maximum value of six points)−(minimum value of six points) is 0.10 or more to less than 0.15.

D: (Maximum value of six points)−(minimum value of six points) is 0.15 or more to less than 0.20.

E: (Maximum value of six points)−(minimum value of six points) is 0.20 or more.

(Evaluation for Transfer Efficiency)

Such A4 images as shown in FIG. 6 (printing ratio: 10%) were outputted under each of N/N, N/L, and H/H environments while a developing bias was adjusted so that a toner mounting amount on a recording material would be 0.6 mg/cm$^2$ at an initial stage of the image output and after the output of 10,000 sheets. Upon image output, transferred toner on a transfer material immediately after the transfer and transfer residual toner on a photosensitive member immediately after the transfer were sampled. A sampling method involved: peeling all toner images with a tape (Super Stick KA PET25 (A) manufactured by Lintec Corporation); sticking the tape to white paper; and measuring the reflection density of the tape with a reflection densitometer X-Rite 500 type from above the tape. Transfer efficiency was calculated from the following formula. Transfer efficiency=(Average density of six points of tape that peeled transferred toner−density of tape alone)/((Average density of six points of tape that peeled transferred toner−density of tape alone)+(Average density of six points of tape that peeled transfer residual toner−density of tape alone))

(Evaluation for Void)

Figure 7:
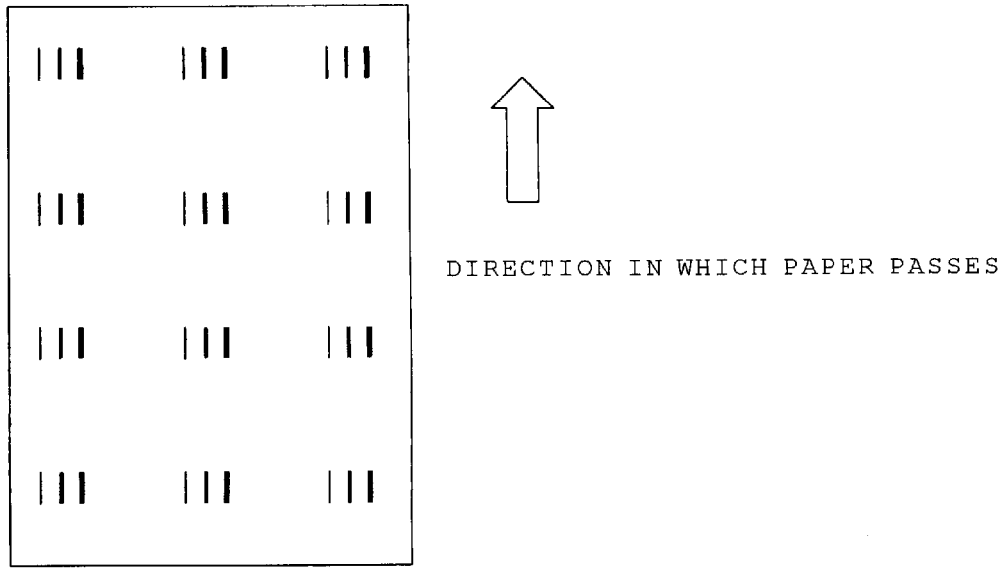
FIG. 7 is a schematic view showing an example of an image subjected to the evaluation of the toner of the present invention for transferability.

Such two A4 images as shown in FIG. 7 were outputted at an initial stage of image output under an H/H environment. Similarly, such two A4 images as shown in FIG. 7 were outputted after the output of 10,000 sheets under the environment. Each of the resultant images was evaluated for void on the basis of the following criteria.

A: A line image shows no void, so the image has high line reproducibility.

B: A slight void is observed with a loupe, but causes no problem in visual observation.

C: A void is visually observed in the thinnest line (line width: 0.1 mm).

D: A void is visually observed in the second-thinnest line (line width: 0.2 mm).

E: A void is visually observed in the thickest line (line width: 0.3 mm).

EXAMPLES 2 to 6

Evaluation for each item was performed in the same manner as in Example 1 except that any one of Toners (T-2) to (T-6) shown in Table 8 was used instead of Toner (T-1) in Example 1. Tables 10, 12, and 14 show the results of evaluation.

COMPARATIVE EXAMPLES 1 to 6

Evaluation for each item was performed in the same manner as in Example 1 except that any one of Toners (t-1) to (t-6) shown in Table 8 was used instead of Toner (T-1) in Example 1. Tables 11, 13, and 15 show the results of evaluation.

Table 10

TABLE 10

| | | Example (evaluation for fixing ability) | | | | |
|---|---|---|---|---|---|---|
| | | Fixing ability (300 mm/sec) | | | Gloss value at a fixation | |
| | Toner | Low-temperature fixability (° C.) | Hot offset property (° C.) | Separability | temperature of 160° C. (glossmeter 60°) | Chroma C* at a fixation temperature of 160° C. |
| Example 1 | Toner (T-1) | 120 | 210 | A | 17.2 | 63 |
| Example 2 | Toner (T-2) | 110 | 190 | A | 19.7 | 64 |
| Example 3 | Toner (T-3) | 125 | 220 | A | 16.5 | 62 |
| Example 4 | Toner (T-4) | 105 | 180 | B | 21.3 | 65 |
| Example 5 | Toner (T-5) | 130 | 220 | B | 15.2 | 61 |
| Example 6 | Toner (T-6) | 115 | 200 | B | 19.2 | 63 |

Table 11

TABLE 11

| Comparative Example (evaluation for fixing ability) | | | | | | |
|---|---|---|---|---|---|---|
| | | Fixing ability (300 mm/sec) | | | Gloss value at a fixation | |
| | Toner | Low-temperature fixability (° C.) | Hot offset property (° C.) | Separability | temperature of 160° C. (glossmeter 60°) | Chroma C* at a fixation temperature of 160° C. |
| Example 1 | Toner (t-1) | 150 | 180 | C | 5.1 | 52 |
| Example 2 | Toner (t-2) | 120 | 130 | E | Unmeasurable | Unmeasurable |
| Example 3 | Toner (t-3) | 200 | 220 | D | Unmeasurable | Unmeasurable |
| Example 4 | Toner (t-4) | 110 | 120 | E | Unmeasurable | Unmeasurable |
| Example 5 | Toner (t-5) | 160 | 220 | C | 4.6 | 49 |
| Example 6 | Toner (t-6) | 150 | 190 | B | 9.2 | 57 |

Table 12

TABLE 12

| Example (evaluation for image density) | | | | | | |
|---|---|---|---|---|---|---|
| | | | Image density | | HT uniformity under an H/H environment | |
| | Toner | Environment | Initial stage | 10,000 sheets | Initial stage | 10,000 sheets |
| Example 1 | Toner (T-1) | N/N | 1.62 | 1.58 | A | A |
| | | N/L | 1.71 | 1.65 | | |
| | | H/H | 1.52 | 1.48 | | |
| Example 2 | Toner (T-2) | N/N | 1.61 | 1.57 | A | A |
| | | N/L | 1.70 | 1.65 | | |
| | | H/H | 1.53 | 1.49 | | |
| Example 3 | Toner (T-3) | N/N | 1.60 | 1.56 | B | B |
| | | N/L | 1.69 | 1.63 | | |
| | | H/H | 1.50 | 1.46 | | |
| Example 4 | Toner (T-4) | N/N | 1.63 | 1.57 | A | A |
| | | N/L | 1.72 | 1.64 | | |
| | | H/H | 1.54 | 1.48 | | |
| Example 5 | Toner (T-5) | N/N | 1.59 | 1.55 | B | C |
| | | N/L | 1.68 | 1.62 | | |
| | | H/H | 1.49 | 1.44 | | |
| Example 6 | Toner (T-6) | N/N | 1.63 | 1.57 | A | A |
| | | N/L | 1.71 | 1.62 | | |
| | | H/H | 1.53 | 1.46 | | |

Table 13

TABLE 13

| Comparative Example (evaluation for image density) | | | | | | |
|---|---|---|---|---|---|---|
| | | | Image density | | HT uniformity under an H/H environment | |
| | Toner | Environment | Initial stage | 10,000 sheets | Initial stage | 10,000 sheets |
| Comparative example 1 | Toner (t-1) | N/N | 1.51 | 1.43 | C | D |
| | | N/L | 1.59 | 1.48 | | |
| | | H/H | 1.41 | 1.30 | | |

TABLE 13-continued

| Comparative Example (evaluation for image density) | | | | | | |
|---|---|---|---|---|---|---|
| | | | Image density | | HT uniformity under an H/H environment | |
| | Toner | Environment | Initial stage | 10,000 sheets | Initial stage | 10,000 sheets |
| Comparative example 2 | Toner (t-2) | N/N | 1.53 | 1.41 | D | E |
| | | N/L | 1.61 | 1.46 | | |
| | | H/H | 1.45 | 1.28 | | |
| Comparative example 3 | Toner (t-3) | N/N | 1.49 | 1.44 | E | E |
| | | N/L | 1.57 | 1.49 | | |
| | | H/H | 1.39 | 1.32 | | |
| Comparative example 4 | Toner (t-4) | N/N | 1.54 | 1.39 | D | E |
| | | N/L | 1.62 | 1.42 | | |
| | | H/H | 1.46 | 1.25 | | |
| Comparative example 5 | Toner (t-5) | N/N | 1.50 | 1.45 | D | E |
| | | N/L | 1.58 | 1.50 | | |
| | | H/H | 1.40 | 1.33 | | |
| Comparative example 6 | Toner (t-6) | N/N | 1.52 | 1.45 | B | C |
| | | N/L | 1.60 | 1.49 | | |
| | | H/H | 1.42 | 1.35 | | |

Table 14

TABLE 14

| Example (evaluation for transferability) | | | | | | |
|---|---|---|---|---|---|---|
| | | | Transfer efficiency (%) | | Evaluation for void under an H/H environment | |
| | Toner | Environment | Initial stage | 10,000 sheets | Initial stage | 10,000 sheets |
| Example 1 | Toner (T-1) | N/N | 98.3 | 97.5 | A | A |
| | | N/L | 99.3 | 98.3 | | |
| | | H/H | 96.7 | 95.8 | | |
| Example 2 | Toner (T-2) | N/N | 98.5 | 97.7 | A | A |
| | | N/L | 99.6 | 98.5 | | |
| | | H/H | 97.1 | 96.2 | | |

TABLE 14-continued

| Example (evaluation for transferability) | | | | | | |
|---|---|---|---|---|---|---|
| | | | Transfer efficiency (%) | | Evaluation for void under an H/H environment | |
| | Toner | Environment | Initial stage | 10,000 sheets | Initial stage | 10,000 sheets |
| Example 3 | Toner (T-3) | N/N | 97.8 | 97.0 | B | B |
| | | N/L | 98.7 | 97.8 | | |
| | | H/H | 95.9 | 94.8 | | |
| Example 4 | Toner (T-4) | N/N | 98.7 | 96.6 | A | B |
| | | N/L | 99.6 | 97.0 | | |
| | | H/H | 97.4 | 94.1 | | |
| Example 5 | Toner (T-5) | N/N | 95.7 | 94.9 | B | C |
| | | N/L | 96.8 | 95.9 | | |
| | | H/H | 94.2 | 93.4 | | |
| Example 6 | Toner (T-6) | N/N | 98.5 | 96.4 | A | B |
| | | N/L | 99.4 | 96.7 | | |
| | | H/H | 97.2 | 93.8 | | |

Table 15

TABLE 15

| Comparative Example (evaluation for transferability) | | | | | | |
|---|---|---|---|---|---|---|
| | | | Transfer efficiency (%) | | Evaluation for void under an H/H environment | |
| | Toner | Environment | Initial stage | 10,000 sheets | Initial stage | 10,000 sheets |
| Comparative example 1 | Toner (t-1) | N/N | 93.5 | 91.7 | C | D |
| | | N/L | 94.4 | 92.2 | | |
| | | H/H | 91.4 | 89.6 | | |
| Comparative example 2 | Toner (t-2) | N/N | 87.6 | 84.5 | D | E |
| | | N/L | 88.8 | 85.9 | | |
| | | H/H | 85.1 | 82.1 | | |
| Comparative example 3 | Toner (t-3) | N/N | 86.5 | 84.6 | E | E |
| | | N/L | 87.6 | 86.0 | | |
| | | H/H | 84.3 | 82.3 | | |
| Comparative example 4 | Toner (t-4) | N/N | 86.3 | 83.1 | D | E |
| | | N/L | 87.5 | 84.3 | | |
| | | H/H | 83.6 | 80.7 | | |
| Comparative example 5 | Toner (t-5) | N/N | 87.8 | 84.9 | E | E |
| | | N/L | 89.0 | 86.1 | | |
| | | H/H | 85.5 | 82.4 | | |
| Comparative example 6 | Toner (t-6) | N/N | 93.8 | 92.0 | B | C |
| | | N/L | 94.7 | 92.6 | | |
| | | H/H | 91.6 | 89.9 | | |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-145551, filed Mar. 25, 2006, which is hereby incorporated by reference here in its entirety.

What is claimed is:

1. A toner comprising toner particles each containing at least a binder resin and a colorant, wherein, in a case where a tetrahydrofuran (THF) insoluble matter of the binder resin in the toner when the toner is subjected to Soxhlet extraction with THF for 2 hours is represented by A (mass %), a THF insoluble matter of the binder resin in the toner when the toner is subjected to Soxhlet extraction with THF for 4 hours is represented by B (mass %), a THF insoluble matter of the binder resin in the toner when the toner is subjected to Soxhlet extraction with THF for 8 hours is represented by C (mass %), and a THF insoluble matter of the binder resin in the toner when the toner is subjected to Soxhlet extraction with THF for 16 hours is represented by D (mass %), A, B, C, and D satisfy the following expression (1):

$$(A-B)/2>(B-C)/4>(C-D)/8 \quad (1)$$

where $40<A\leqq 75$ (mass %) and $1.0<D<40$ (mass %).

2. A toner according to claim 1, wherein the toner has a highest endothermic peak at 50 to 110° C. in an endothermic curve in differential scanning calorimetry (DSC).

3. A toner according to claim 1, wherein the toner has a storage elastic modulus G' (140° C.) at 140° C. of $1.0\times10^3$ dN/m$^2$ or more to less than $1.0\times10^5$ dN/m$^2$.

4. A toner according to claim 1, wherein the toner has an average circularity of 0.945 or more to 0.990 or less, the average circularity being obtained by dividing circularities measured with a flow-type particle image measuring device having an image processing resolution of 512×512 pixels (0.37 μm×0.37 μm per pixel) into 800 sections in a circularity range of 0.200 or more to 1.000 or less and by analyzing the circularities.

5. A toner according to claim 1, wherein the binder resin have a low-softening-point resin having a softening point of 80.0° C. or higher to lower than 110.0° C. and having a polyester unit and a vinyl-based copolymer unit, and a high-softening-point resin having a softening point of 110.0° C. or higher to 145.0° C. or lower and having a polyester unit and a vinyl-based copolymer unit.

* * * * *